US007445313B2

(12) United States Patent
Tsutsumi et al.

(10) Patent No.: US 7,445,313 B2
(45) Date of Patent: Nov. 4, 2008

(54) INKJET RECORDING APPARATUS

(75) Inventors: Takashi Tsutsumi, Hachioji (JP); Toyoaki Sugaya, Hachioji (JP); Masaru Nagai, Hachioji (JP)

(73) Assignee: Konica Minolta Holdings Inc., Tokyo (JP)

( * ) Notice: Subject to any disclaimer, the term of this patent is extended or adjusted under 35 U.S.C. 154(b) by 85 days.

(21) Appl. No.: 11/216,922

(22) Filed: Aug. 31, 2005

(65) Prior Publication Data

US 2006/0044331 A1 Mar. 2, 2006

(30) Foreign Application Priority Data

Sep. 1, 2004 (JP) ..... 2004-254318
Jan. 18, 2005 (JP) ..... 2005-010507

(51) Int. Cl.
*B41J 2/15* (2006.01)

(52) U.S. Cl. ..... 347/41; 347/16; 347/105

(58) Field of Classification Search ..... 347/16, 347/41, 105; 400/578–648
See application file for complete search history.

(56) References Cited

U.S. PATENT DOCUMENTS 2,127,652 A * 8/1938 Placke et al. ..... 400/620
6,460,963 B1 * 10/2002 Endo ..... 347/19
6,779,865 B2 * 8/2004 Shibata et al. ..... 347/19
6,969,141 B2 * 11/2005 Horiuchi et al. ..... 347/19
7,165,823 B2 * 1/2007 Yakura et al. ..... 347/12
2002/0021323 A1 * 2/2002 Kanazawa et al. ..... 347/41
2002/0175971 A1 * 11/2002 Otsuki ..... 347/43
2004/0233249 A1 * 11/2004 Vanhooydonck ..... 347/41

FOREIGN PATENT DOCUMENTS

JP 2002-011865 A 1/2002
JP 2002-036530 A 2/2002

* cited by examiner

*Primary Examiner*—Matthew Luu
*Assistant Examiner*—Justin Seo
(74) *Attorney, Agent, or Firm*—Frishauf, Holtz, Goodman & Chick, P.C.

(57) ABSTRACT

An inkjet recording apparatus including: a line head type recording head having nozzles for jetting ink to a recording medium; a moving apparatus for moving the recording head relative to the medium in a nozzle arrangement direction; a conveyance apparatus for conveying the medium reciprocally, relative to the recording head in a direction orthogonal to the nozzle arrangement direction; a head driving section for controlling the recording head so that the recording head jets ink based on inputted image information; and a control section for controlling the conveyance apparatus so that the amount of the frontward movement of the medium in an outward route is larger than the amount of the backward movement in a homeward route and for controlling the moving apparatus, when the conveyance direction is switched, so that the recording head is moved relative to the medium in the nozzle arrangement direction.

3 Claims, 42 Drawing Sheets

INKJET RECORDING APPARATUS

BACKGROUND OF THE INVENTION

1. Field of the Invention

The present invention relates to an inkjet recording apparatus. In particular, the present invention relates to a line head type inkjet recording apparatus.

2. Description of Related Art

Generally, among inkjet recording apparatuses, there are for example those of the serial head type in which a recording head is moved on a recording medium in a reciprocating manner so that the recording medium is conveyed in a direction orthogonal to a scanning direction of the recording head to form an image or those of the line head type in which a recording head fixed to have a nozzle row extending along the width of a recording medium so that the recording medium is conveyed in a direction perpendicular to the direction of the nozzle row to form an image.

In the line head type inkjet recording apparatus 50, the position or direction of the nozzles of the recording head 53 is dislocated to cause, as shown in FIG. 46 to FIG. 48, the displacement of ink jetting positions. This causes a case in which, even when the respective nozzles jet the same amount of ink, the stripe uneven recording 51 may be frequently generated in a direction along which the recording medium 52 is conveyed, causing a significant deterioration of image quality.

Thus, in order to prevent the deterioration of image quality as described above, various methods have been suggested. One method intends, for example, to use a so-called interleave to disperse the dislocations of ink jetting positions so that stripe uneven recording is reduced. The term "interleave" herein means a method in which a recording of a plurality of neighboring pixels is completed by a plurality of scanning operations.

Specifically, in a method for an image recording apparatus having a line head type recording head and a drum-like recording medium retention section, the recording medium retention section is rotated together with a recording medium so that a plurality of recordings are performed in an image recording of one scanning to record pixels such that every "n" pixel(s) ("n" is an integer of one or more) is/are recorded in at least one of a direction in which nozzles are arranged or a direction in which the medium is conveyed, thereby completing the image. As a result, dislocations of ink jetting positions can be dispersed, thereby reducing the deterioration of the image quality due to uneven recording or the like (see JP-Tokukai-2002-11865A).

When an image recording is completed by a plurality of scannings in an image recording apparatus having a line head-type recording head and a flat plate-like recording medium retention section, it is necessary to convey, in a reciprocating manner repeatedly, a recording medium at the lower part of the recording head while switching the conveyance directions. Thus, there is one method in which an image recording is completed by repeating a step for moving, when the conveyance direction of a recording medium is switched during the conveyance of the medium in a reciprocating manner, the position of the recording head in the nozzle arrangement direction. With this method, even an image recording apparatus having a flat plate-like recording medium retention section can perform a image recording by a plurality of scannings with the resolution equal to or higher than a nozzle interval of the recording head (see JP-Tokukai-2002-36530A).

However, when the line head type inkjet recording apparatus having a flat-surface-like recording medium retention section performs an image recording by the above interleave, an image recording is completed by a plurality of scannings in which the front end or rear end of a recording medium is conveyed at the lower part of the recording head to subsequently invert the conveyance direction of the recording medium to convey the recording medium in a reciprocating manner. This causes, as shown in FIG. 49, the conveyance amount L in the conveyance direction of the recording medium in one scanning to be larger than the sum of the length Lm of the recording medium and the length Lh of a region including the plurality of recording heads 53. This has caused a problem in conventional inkjet recording printers in that an increased time is required for the image recording when the plurality of recording heads 53 are used because the conveyance amount L for one scanning is increased and an image recording to another recording medium cannot be started until recording to the current recording medium is completed by performing a predetermined number of scannings.

When a recording is performed by the plurality of recording heads 53, the time from a recording by the first recording head 53 to a recording by the second recording head 53 is short. Thus, ink jetted from the second recording head 53 is performed within a time in which ink jetted from the first recording head 53 is not sufficiently absorbed by the recording medium 52, causing a problem in which a plurality of inks jetted from different recording heads have a bleeding, causing the deterioration of the image quality.

SUMMARY OF THE INVENTION

The present invention was made in order to solve the problems as described above. It is an object of the invention to provide an inkjet recording apparatus according to which a line head type recording apparatus provides an image recording with a resolution equal to or higher than a nozzle interval so that the deterioration of image quality due to uneven recording can be reduced and the recording time can be shortened.

DETAILED DESCRIPTION OF THE INVENTION

Figure 1:
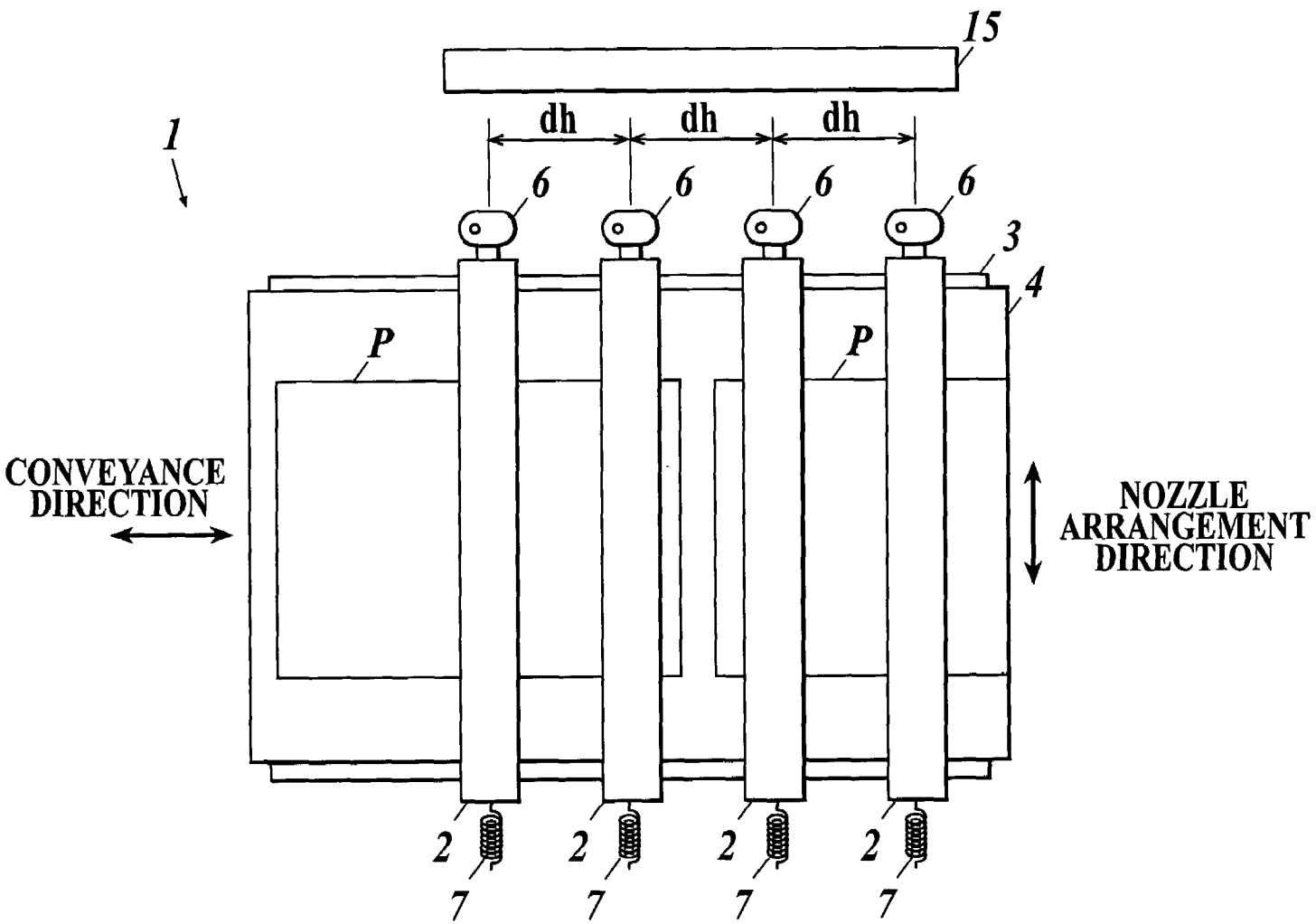
FIG. 1 is a schematic top view illustrating an inkjet recording apparatus according to the present invention.

Hereinafter, an inkjet recording apparatus according to the present invention is described with reference to the drawings. However, the illustrated examples in the drawings do not intend to limit the scope of the invention.

Embodiment 1

FIG. 1 is a schematic view of an inkjet recording apparatus 1 according to this embodiment. The inkjet recording apparatus 1 is the line head type inkjet recording apparatus 1 for forming an image using a line type recording head 2 orthogonal to the conveyance direction of the recording medium P.

This inkjet recording apparatus 1 includes a platen 3 for supporting, from the lower part, the recording medium P. The platen 3 includes a conveyance apparatus 4 consisting of a conveyance belt or the like for conveying the recording medium P in an intermittent manner. At a position that is above the platen 3 and that is above the recording medium P, there are provided a plurality of recording heads 2 for jetting the respective colors of inks (Y:yellow, M:magenta, C:cyan, K:black) in a direction orthogonal to the conveyance direction of the recording medium P. The respective recording heads 2 are provided so as to have a predetermined interval "dh" thereamong in the conveyance direction of the recording medium P.

At a face of each recording head 2 that is opposed to the recording medium P, there are provided a plurality of nozzles for jetting predetermined ink toward the recording medium P that are provided in a substantially straight line orthogonal to the conveyance direction.

Each recording head 2 includes a no-jet detection mechanism 15 for detecting when ink is not jetted. This no-jet detection mechanism 15 includes a laser irradiation section (not shown) for irradiating laser to ink droplets jetted from the recording head 2 and a laser detection section (not shown) for detecting when ink is not jetted by determining whether the laser from this laser irradiation section is blocked by ink droplets or not.

Each recording head 2 includes a moving apparatus 5 for moving the respective recording head 2 in the nozzle arrangement direction. The moving apparatus 5 includes: an eccentric cam 6 that is abutted with one end of the recording head 2 in the nozzle arrangement direction and that is rotated by being driven by a motor (not shown); and a spring 7 that is connected to the other end of the recording head 2 in the nozzle arrangement direction and that pushes the recording head 2 toward the eccentric cam 6. By rotating the eccentric cam 6, the recording head 2 is moved in the nozzle arrangement direction while following the shape of the eccentric cam 6.

Figure 2:
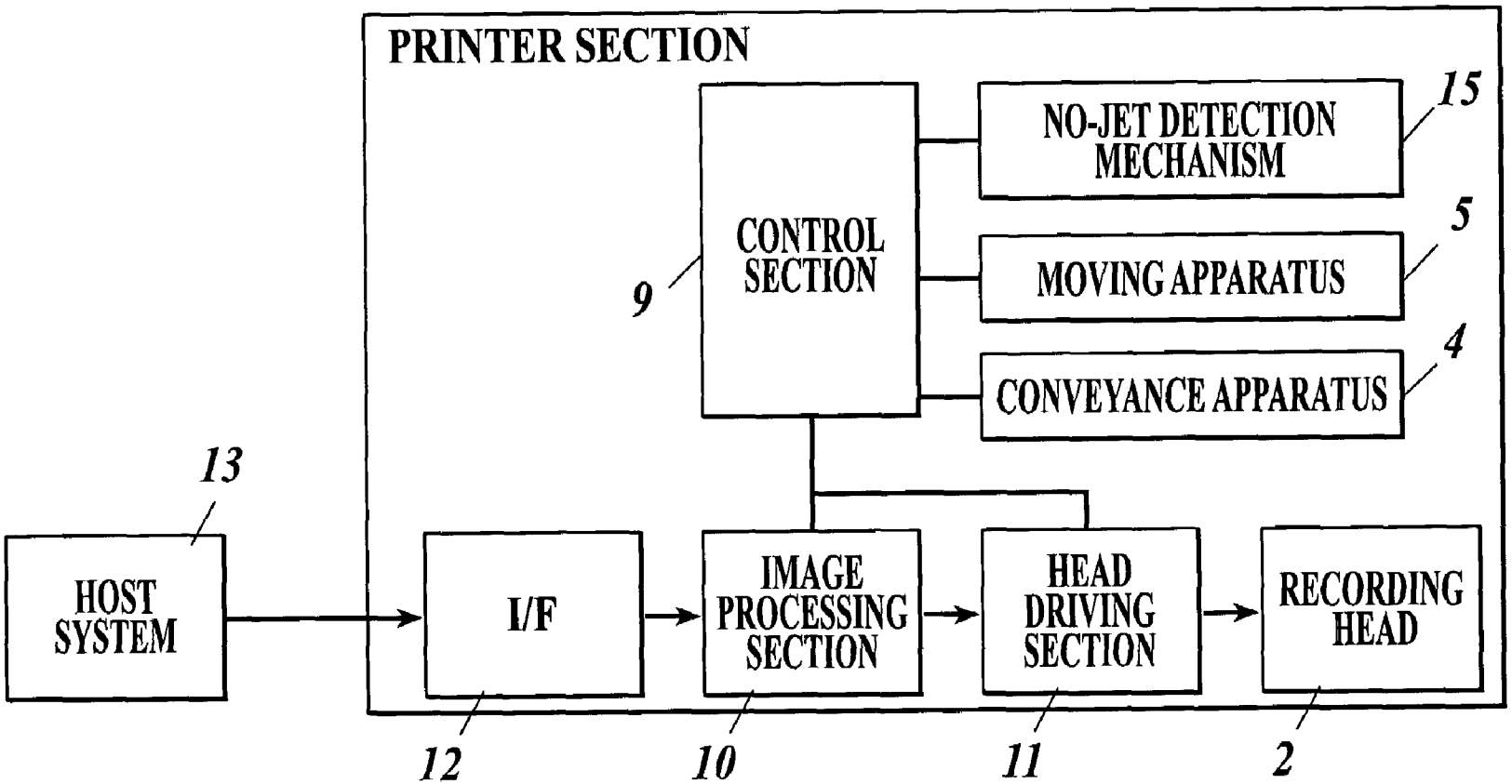
FIG. 2 is a block diagram illustrating a main control apparatus of the inkjet recording apparatus according to the invention.
Figure 3:
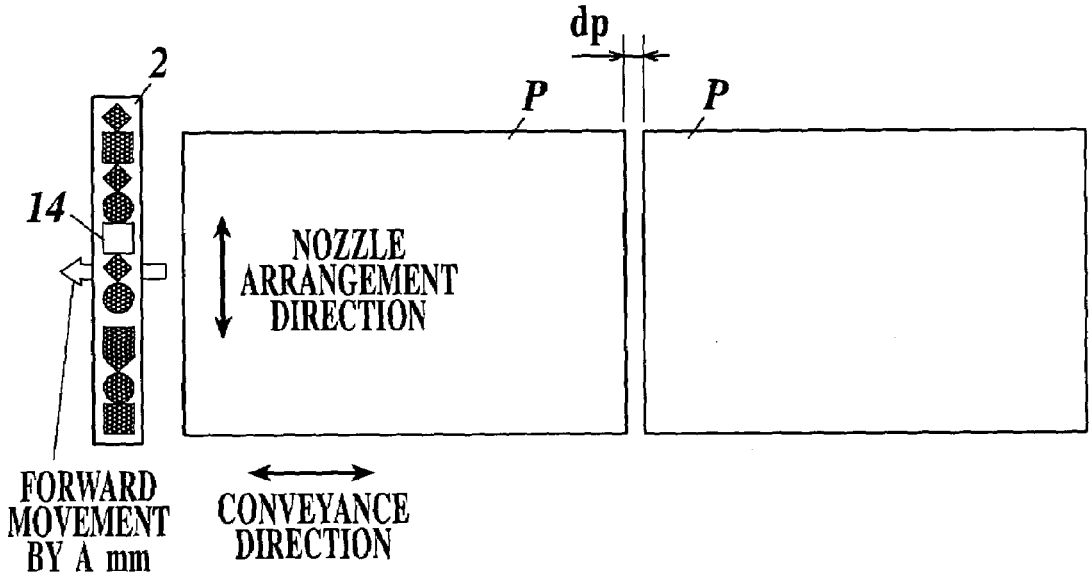
FIG. 3 is an illustration of a recording method in Embodiment 1.
Figure 4:
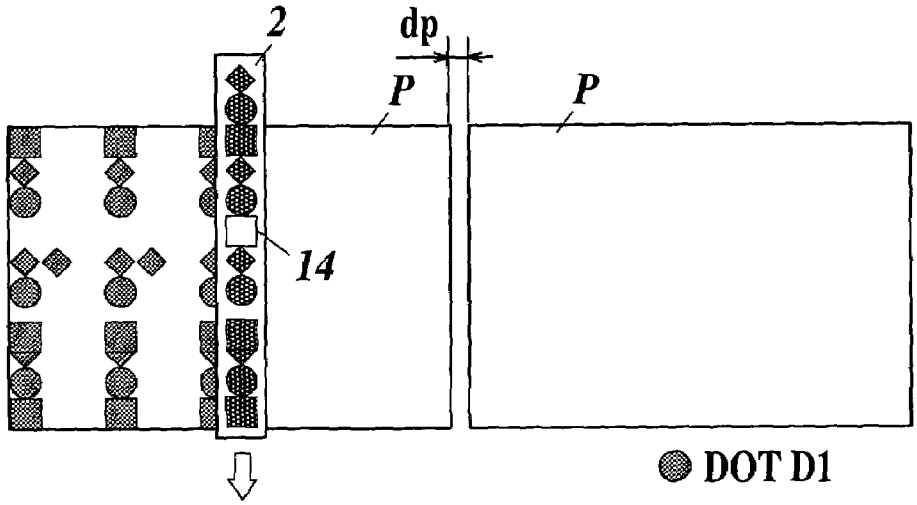
FIG. 4 is an illustration of the recording method in Embodiment 1.
Figure 5:
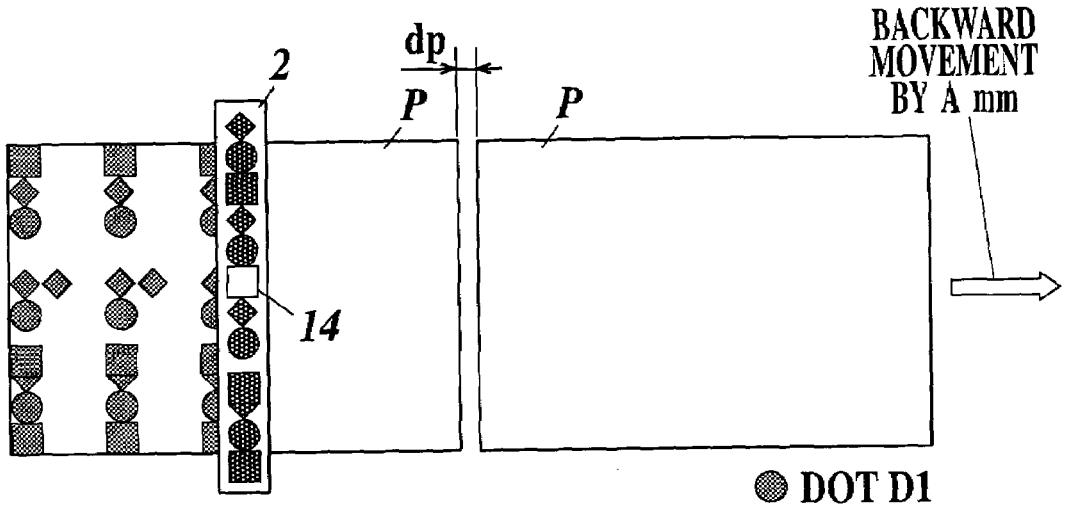
FIG. 5 is an illustration of the recording method in Embodiment 1.
Figure 6:
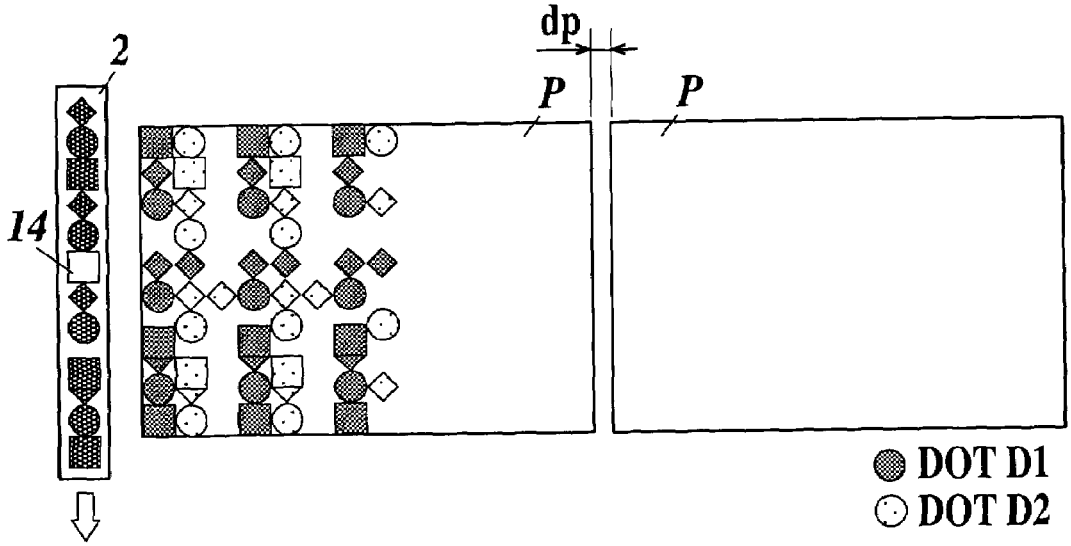
FIG. 6 is an illustration of the recording method in Embodiment 1.
Figure 7:
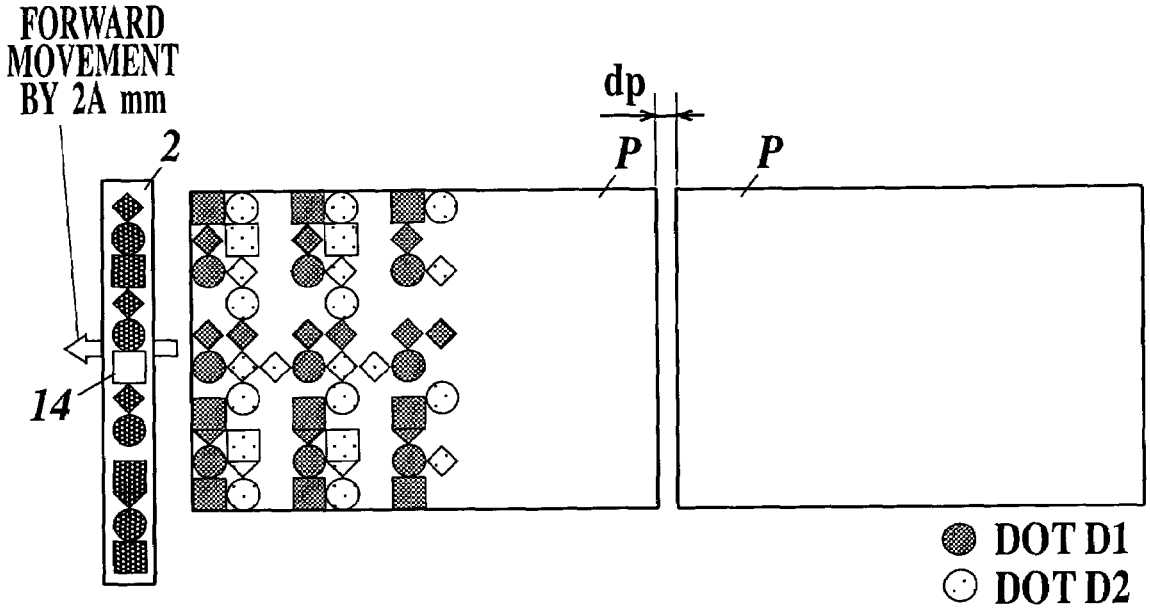
FIG. 7 is an illustration of the recording method in Embodiment 1.
Figure 8:
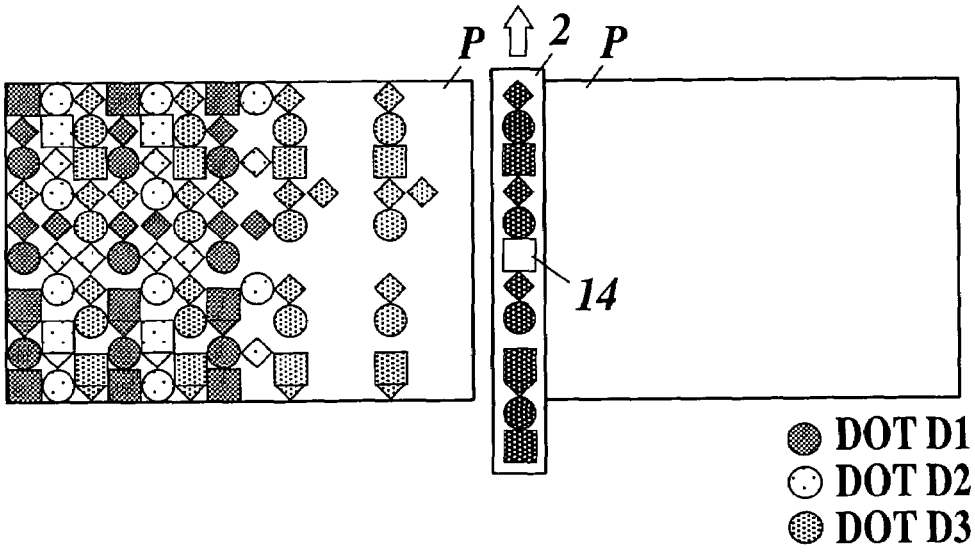
FIG. 8 is an illustration of the recording method in Embodiment 1.
Figure 9:
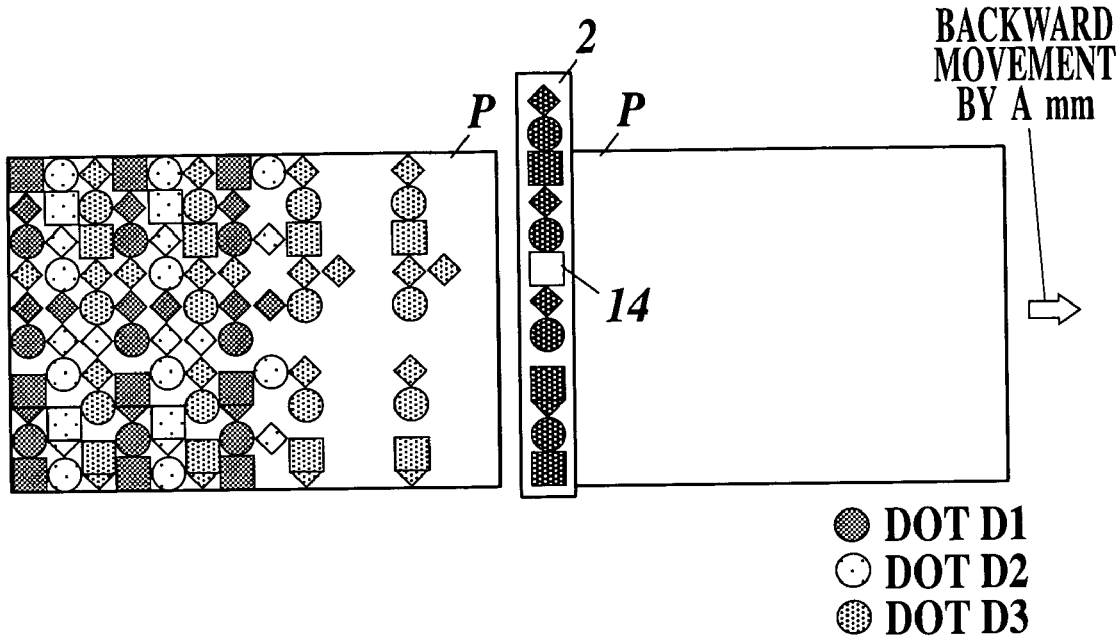
FIG. 9 is an illustration of the recording method in Embodiment 1.
Figure 10:
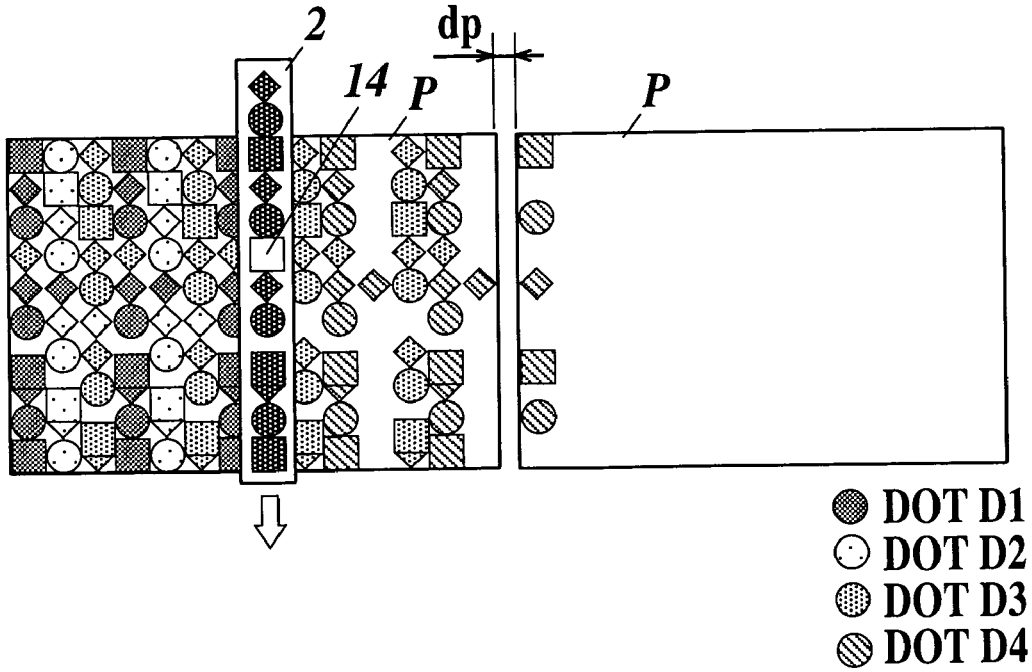
FIG. 10 is an illustration of the recording method in Embodiment 1.
Figure 11:
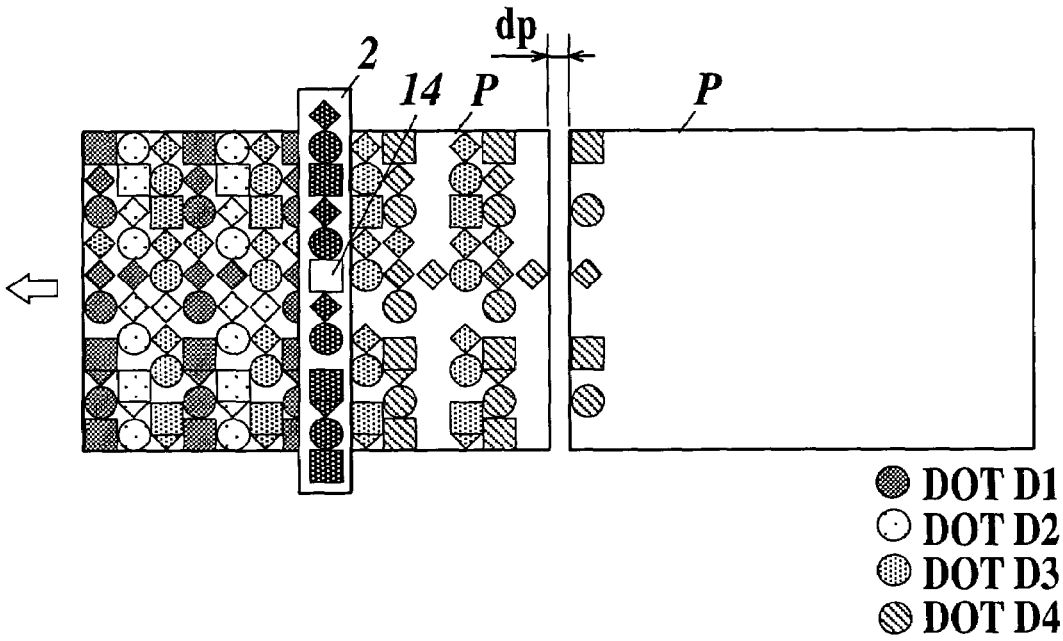
FIG. 11 is an illustration of the recording method in Embodiment 1.
Figure 12:
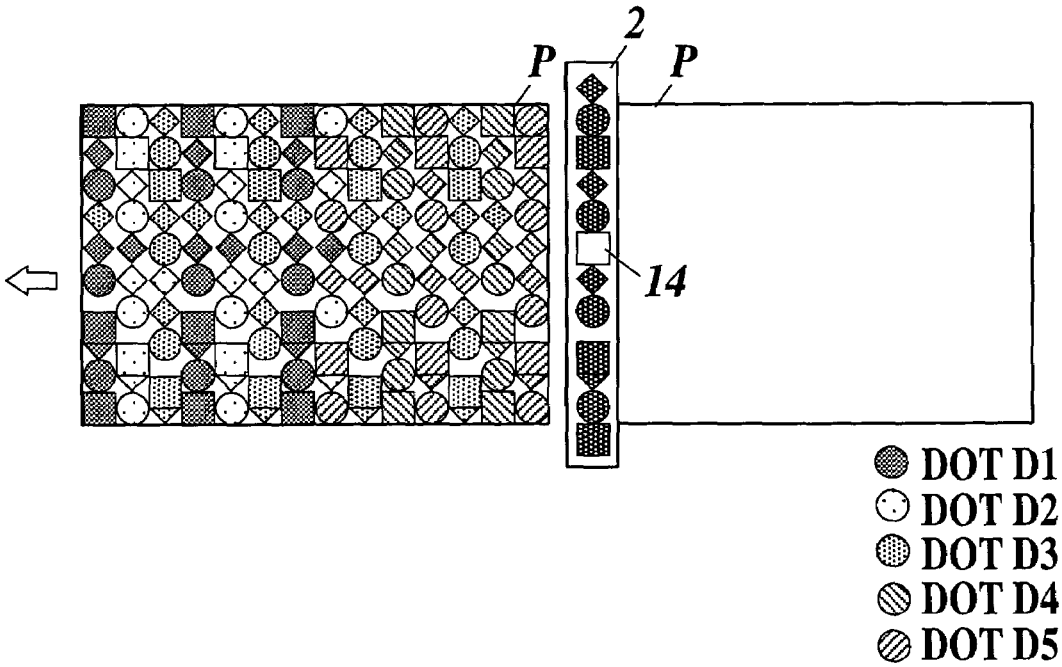
FIG. 12 is an illustration of the recording method in Embodiment 1.

Next, with reference to FIG. 2, the main control apparatus in the inkjet recording apparatus 1 is described. FIG. 2 is a block diagram illustrating the main control apparatus of the inkjet recording apparatus 1.

As shown in FIG. 2, the inkjet recording apparatus 1 of this embodiment includes a control section 9. The control section 9 is electrically connected with the no-jet detection mechanism 15, the conveyance apparatus 4, the moving apparatus 5, an image processing section 10, and a head driving section 11.

The inkjet recording apparatus 1 includes an interface (I/F) 12 for sending, from a host system 13, image data for a recording or information inputted for controlling an operation.

The interface (I/F) 12 is connected with the image processing section 10 for decoding the encoded image data for a recording sent from the host system 13 to have a data format that can be processed by the inkjet recording apparatus 1.

The image processing section 10 is connected with the control section 9 and the head driving section 11 for controlling, based on a signal sent from the control section 9 and the image data for a recording obtained from the image processing section 10, the driving of the recording head 2 so that the image is recorded.

The head driving section 11 controls the recording head 2 so that the ink jet method by the recording head 2 is a three scan interleave. Thus, the recording head 2 is controlled so that one dot is recorded, for every three dots, in the conveyance direction by one scanning and neighboring three dots in the conveyance direction are recorded by the three scannings.

When the no-jet detection mechanism 15 detects that the recording head 2 has a no-jet nozzle 14, the head driving section 11 controls the recording head 2 so that nozzles other than the no-jet nozzle 14 are caused to jet ink toward a region opposed to the no-jet nozzle 14 to continuously form dots along the conveyance direction. The head driving section 11 also controls the recording head 2 so that nozzles other than the no-jet nozzle 14 can jet ink, in a subsequent scanning, to a blank dot that was opposed to the no-jet nozzle 1.4 and thus was not recorded.

The head driving section 11 also controls the recording head 2 so that a position in the recording medium P in the vicinity of a part at which the conveyance direction is switched is subjected to a dot thinning-out operation in the nozzle arrangement direction to complete a image recording by a multiple scanning.

The control section 9 controls the moving apparatus 5 so that, whenever the conveyance direction of the recording medium P is switched, the recording head 2 is moved in the nozzle arrangement direction. Specifically, the control section 9 controls the moving apparatus 5 so that a step for moving the recording head 2 to one side of the nozzle arrangement direction by the distance of a nozzle interval is performed two times and a step for moving the recording head 2 to the other side of the nozzle arrangement direction by the distance obtained by doubling the nozzle interval is performed one time such that the two former steps and the one latter step are performed alternately.

The control section 9 also controls the conveyance apparatus 4 so that the amount of frontward movement of the recording medium P in the outward route is larger than the amount of the backward movement in the homeward route and so that the recording medium P is conveyed toward the downstream of the conveyance direction by an amount obtained by deducting, from the amount of the frontward movement in the outward route, the amount of the backward movement in the homeward route. Specifically, the control is provided so that the recording medium P has a backward movement of "A" mm in an even numbered scanning operation while the recording medium P has a frontward movement of "2A" mm in an odd-numbered scanning operation other than the first one so that the recording medium P is conveyed in the frontward direction by "A" mm that is obtained by deducting "A" mm from "2A" mm. The control section 9 controls the conveyance apparatus 4 so that the amount of the frontward movement of "2A" mm of the recording medium P is smaller than the interval "dh" of the recording head 2. The control section 9 also controls the conveyance apparatus 4 so that the amount of the frontward movement of "2A" mm of the recording medium P and the amount of the backward movement of "A" mm are smaller than the length of the recording medium. Thus, the conveyance amount in one scanning can be reduced and the recording medium P can be sequentially subjected to image recordings.

The control section 9 is also designed to appropriately cause the no-jet detection mechanism 15 to detect whether the recording head 2 includes the no-jet nozzle 14 or not. When the no-jet detection mechanism 15 detects the no-jet nozzle 14, the control section 9 sends the detection result to the head driving section 11.

Next, an image recording by the inkjet recording apparatus 1 according to this embodiment is described with reference to FIG. 3 to FIG. 12. For convenience, the following description assumes a case where all pixels are recorded on the recording medium P.

First, prior to the start of the image recording, the no-jet detection mechanism 15 causes the laser irradiation section to irradiate laser to ink droplets jetted from the recording head 2. Then, the no-jet detection mechanism 15 detects the existence or nonexistence of the no-jet nozzle 14 by causing the laser detection section to detect whether this laser is blocked by the ink droplets or not.

Next, when predetermined to-be-recorded image information is inputted from the host system 13 to the control section 9, the motor of the moving apparatus 5 drives and rotates the eccentric cam 6. Then, in accordance with the rotation of the eccentric cam 6, the position of the recording head 2 in the nozzle arrangement direction is adjusted. Then, the conveyance apparatus 4 moves the record-starting position of the recording medium P to a position opposed to the recording head 2 (see FIG. 3).

Then, the first scanning is started. Specifically, the conveyance apparatus 4 is used to convey the recording medium P by "A" mm to the downstream of the conveyance direction while recording, for every three dots, the one dot D1 from the recording head 2 in the conveyance direction (see FIG. 4). Then, since the no-jet nozzle 14 has already been detected by the no-jet detection mechanism 15, the head driving section 11 causes, in the first scanning, a nozzle neighboring to the no-jet nozzle 14 to record, for every three dots, the two dots D1 in the conveyance direction.

Next, the conveyance operation by the conveyance apparatus 4 is stopped to stop the recording medium P. While the recording medium P being stopped, the motor of the moving apparatus 5 drives and rotates the eccentric cam 6 so that the recording head 2 is moved by the nozzle interval toward one side of the nozzle arrangement direction while following the rotation of the eccentric cam 6 (see FIG. 5).

Next, the second scanning is started. Specifically, the conveyance apparatus 4 is used to convey the recording medium P by "A" mm to the upstream of the conveyance direction while recording the dots D2 from the recording head 2. The dots D2 are dislocated from the dots D1 by the width of one dot to the upstream of the conveyance direction and by a nozzle interval to one side of the nozzle arrangement direction (see FIG. 6). The head driving section 11 has already caused, in the first scanning, a neighboring nozzle to record the dots D1 to the position that is opposed to the no-jet nozzle 14 in the second scanning. Furthermore, the head driving section 11 causes, in the second scanning, another nozzle to record the dots D2 to the position that is opposed to the no-jet nozzle 14 in the third scanning. Thus, even when the recording head 2 includes the no-jet nozzle 14, ink jet from another nozzle is adjusted to record all images.

Additionally, when the second scanning is started, a position at which the conveyance direction of the recording medium P is switched is recorded, in the nozzle arrangement direction, with the dots D2 for every one dot.

Next, the conveyance operation by the conveyance apparatus 4 is stopped to stop the recording medium P. While the recording medium P being stopped, the moving apparatus 5 causes the recording head 2 to move by a nozzle interval toward one side of the nozzle arrangement direction (see FIG. 7).

Then, the third scanning is started. Specifically, the conveyance apparatus 4 is used to convey the recording medium P by "2A" mm to the downstream of the conveyance direction while recording the dots D3 from the recording head 2 so as to fill one nozzle row neighboring to the dots D2 in the nozzle arrangement direction and blank dots that were opposed to the no-jet nozzle 14 in the first scanning and thus were not recorded (see FIG. 8). Then, the conveyance apparatus 4 continuously conveys the second recording medium P following the first recording medium P between which the predetermined interval "dp" is provided so that the recording is provided to the position of the second recording medium P that corresponds to a position "2A" mm far from the record-starting position of the third scanning. As in the second scanning, the head driving section 11 has already caused, in the third scanning, the position opposed to the no-jet nozzle 14 to be printed with the dots D2. In this manner, the third scanning completes the image recording for a part of "A" mm from the record-starting position of the recording medium P.

Hereinafter, the image recording for a part of "A" mm in the upstream of the conveyance direction is further performed.

The conveyance operation by the conveyance apparatus 4 is stopped to stop the recording medium P. While the recording medium P being stopped, the moving apparatus 5 moves, toward the other side of the nozzle arrangement direction, the recording head 2 for a distance that is two times longer than the nozzle interval (see FIG. 9).

Next, the fourth scanning is started. Specifically, the conveyance apparatus 4 is used to convey the recording medium P by "A" mm to the upstream of the conveyance direction while recording, from the recording head 2, the dots D4 that have the same arrangement as that of the dots D1 (see FIG. 10). As in the second scanning, when the fourth scanning is started, a position at which the conveyance direction of the recording medium P is switched is recorded, for every one dot, with the dots D4 in the nozzle arrangement direction.

Next, the conveyance of the recording medium P is stopped. While the recording medium P being stopped, the recording head 2 is moved, by the nozzle interval, toward the shown one side in the nozzle arrangement direction (see FIG. 11), thereby starting the fifth scanning. While the recording medium P being conveyed, by the conveyance apparatus 4, by "2A" mm toward the upstream of the conveyance direction, the recording medium P is recorded by the recording head 2 with the dots D5 having the same arrangement as that of the dots D2 (see FIG. 12).

When the fifth scanning is started, a position at which the conveyance direction of the recording medium P is switched corresponds to a position at which the conveyance direction of the recording medium P is switched when the second scanning is started. The head driving section 11 causes a position that was not recorded with the dots D2 in the second scanning to be recorded with the dots D5 in the nozzle arrangement direction for every one dot. Thus, even when an error in the conveyance amount of the recording medium P occurs, stripe uneven recording generated at a position at which the conveyance direction is switched can be suppressed to an unnoticeable level because a recording of one line in the nozzle arrangement direction is completed by two scannings.

By the manner as described above, the image recording for the part of "A" mm is completed.

Thereafter, the image recording is performed for every "A" mm part toward the downstream of the conveyance direction of the recording medium P as described above.

Although the above description specified that, with regards to a position at which the conveyance direction of the recording medium P is switched, only one line in the nozzle arrangement direction is recorded by two scannings. However, this recording also may be performed such that a plurality of lines in the vicinity of the switching position is recorded by two scannings. Specifically, the first "n" line(s) ("n" is an integer of one or more) in the second scanning of the above embodiment is/are recorded with the dots D2 in the nozzle arrangement direction for every one dot. With regards to the first "n" line(s) in the fifth scanning, a position in the same line as the first "n" line(s) of the second scanning that was not recorded with the dots D2 is recorded with the dots D5. In this case, a part at which the conveyance direction is switched extends over a plurality of lines and thus the generation of stripe uneven recording can be suppressed more effectively.

Although the description with reference to FIG. 3 to FIG. 10 described the recording head 2 as one head, the same control depending on the position of the recording medium P is provided by the head driving section 11, in an actual case, to the four recording heads 2 of "Y", "M", "C", and "K" shown in FIG. 1. In this control, the amount of one frontward movement of "2A" mm of the recording medium is made smaller than the head interval "dh". This can secure a sufficient time for the recording medium P to absorb ink in a period from a time at which one recording head provides a recording to a position to a time at which the next recording head provides a recording to the same position. As a result, the respective colors of inks can be prevented from having bleeding.

As described above, the inkjet recording apparatus 1 of this embodiment causes, whenever the conveyance direction of the recording medium P is switched, the position of the recording head 2 in the nozzle arrangement direction to be moved to subsequently perform a recording so that the recording is performed while the ink jet method by recording head 2 is the three scan interleave. This can disperse the ink jetting positions and the line head type recording head 2 can be used to reduce the deterioration of the image quality due to uneven recording.

Furthermore, the control is also provided, as described above, so that the amount of the frontward movement of the recording medium P in the outward route is larger than the amount of the backward movement in the homeward route. Thus, the recording medium P can be sequentially recorded while conveying, in the frontward direction, the recording medium P by "A" mm, which is obtained by deducting the amount of the movement in the outward route from the amount of the movement in the homeward route. Thus, a conveyance path provided below the recording head 2 can be shortened, thus providing the entireties of the conveyance apparatus 4 and the recording apparatus with a smaller size.

A plurality of recording media P can be simultaneously recorded with the predetermined interval "dp" thereamong as described above. Thus, it is not necessary to wait for the recording of one recording medium P to be completed in order to start the recording of the next recording medium P. Thus, the time required for recording an image to a plurality of recording media P can be reduced.

Furthermore, when the plurality of recording heads 2 are used to perform a recording, "2A" mm, which is the amount of one frontward movement of the recording medium P, is smaller than the interval "dh" of the recording head 2. This can secure a sufficient time for the recording medium P to absorb ink in a period from a time at which one recording head 2 provides a recording to a position to a time at which the next recording head 2 provides a recording to the same position. As a result, inks jetted from the different recording head 2 can be prevented from having a bleeding.

The neighborhood of a position at which the conveyance direction of the recording medium P is switched is recorded, in a stepwise manner, by a plurality of scanning operations as described above. Thus, even when an error occurs in the conveyance amounts of the recording medium P, it is possible to suppress, to an unnoticeable level, the stripe uneven recording at the above switching position.

Furthermore, the head driving section 11 controls the recording head 2 so that the recording head 2 jets ink based on inputted image information and the detection result by the no-jet detection mechanism 15. Thus, even when the no-jet nozzle 14 is generated, the no-jet nozzle 14 can be complemented easily.

Although this embodiment includes the no-jet detection mechanism 15 for detecting a no-inkjet status, the no-jet detection mechanism 15 may be omitted. Instead of the no-jet detection mechanism 15, a test chart printed from the recording head 2 prior to the start of a recording also may be used for example to check the existence or nonexistence of the no-jet nozzle 14.

In this case, the control section 9 can switch between an automatic detection mode and a manual detection mode for a no-jet nozzle. When the automatic detection mode is specified, the no-jet detection mechanism 15 may be used to detect a no-jet nozzle as described above. The host system 13 also includes a function as an input means so that various instructions can be inputted via the host system 13.

When the manual detection mode is specified on the other hand, the control section 9 can cause the head driving section 11 and the conveyance apparatus 4 to print a test chart. By visually recognizing the printed test chart for example, a user visually checks the existence or nonexistence of the no-jet nozzle 14. When confirming the generation of the no-jet nozzle 14, the user inputs, via the host system 13, the position of the no-jet nozzle 14 and the head driving section 11 controls the recording head 2 so that the another nozzle can jet ink toward a no-ink-jet region 16.

Thus, when the user or the like inputs, via the host system 13 as an input means, the position of the no-jet nozzle 14, then the head driving section 11 causes the no-ink-jet region 16 to let another nozzle to jet ink. As a result, even when the no-jet nozzle 14 is generated, the no-jet nozzle 14 can be complemented.

Embodiment 2

Next, Embodiment 2 according to the present invention is described. An inkjet recording apparatus of this embodiment has substantially the same structure as that of the inkjet recording apparatus 1 of Embodiment 1 except for a process for performing an image recording. Specifically, the difference is that Embodiment 1 causes the dot thinning-out in the conveyance direction while Embodiment 2 controls each component so that the dot thinning-out is not performed in the conveyance direction and in the nozzle arrangement direction. In Embodiment 2, the three scan interleave is provided to record an image in a predetermined region by three scanning operations so that the recording is performed with a resolution equal to or higher than the nozzle interval of the recording head 2.

The following section describes the respective control configurations.

The control section 9 controls the moving apparatus 5 so that, whenever the conveyance direction of the recording medium P is switched, the recording head 2 is moved in the nozzle arrangement direction. When the nozzle interval is assumed as "X", an amount of the movement of the recording head 2 at the switching of the conveyance direction is a distance represented by mX/(the number of interleave(s)) ("m" is a natural number and "m" and the number of interleave(s) are natural numbers coprime to each other). In other words, since this embodiment specifies the interleave of in the nozzle arrangement direction as "3", the moving distance is controlled so as to provide (1/3)X, (2/3)X, (4/3)X, . . . . However, the following section describes this embodiment on the assumption that the moving distance is (4/3)X. The following section also assumes that the recording head 2 is moved two times to the lower part of the nozzle arrangement direction and two times to the upper part of the nozzle arrangement direction in the drawing.

As in Embodiment 1, the control section 9 controls the conveyance apparatus 4 so that the amount of the frontward movement of the recording medium P in the outward route is larger than the amount of the backward movement in the homeward route and so that the recording medium P is conveyed toward the downstream of the conveyance direction by an amount obtained by deducting, from the amount of the frontward movement in the outward route, the amount of the backward movement in the homeward route. Specifically, the control is provided so that the recording medium P has a backward movement of "A" mm in an even numbered scanning operation while the recording medium P has a frontward movement of "2A" mm in an odd-numbered scanning operation other than the first one so that the recording medium P is conveyed in the frontward direction by "A" mm that is obtained by deducting "A" mm from "2A" mm.

Next, the operation of the inkjet recording apparatus 1 in this embodiment is described.

It is noted that, for convenience, this embodiment assumes that all nozzles in the recording head 2 are not clogged.

Figure 13:
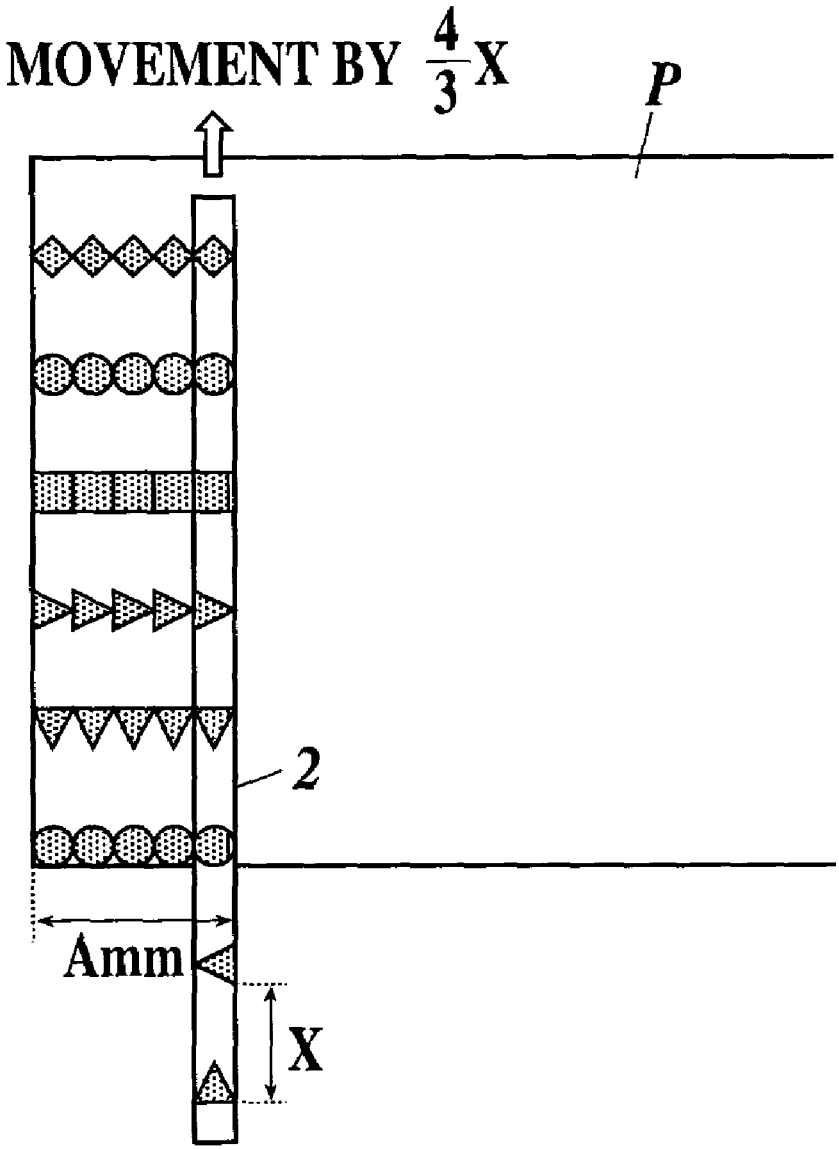
FIG. 13 is an illustration of a recording method in Embodiment 2.

First, the control section 9 is inputted with predetermined information regarding a to-be-recorded image. Then, the recording head 2 and the recording medium P are moved to a predetermined position. Thereafter, the first scanning is started in which the recording medium P is conveyed to the downstream of the conveyance direction by "A" mm, thereby recording an image as shown in FIG. 13. FIG. 13 shows the recording head 2 and the recording medium P after the first scanning. The dots provided with the hatching represent those recorded by the first scanning. Similarly, with regards to the dots in the drawings, only the dots recorded in each scanning operation is provided with a hatching in the following description.

Figure 14:
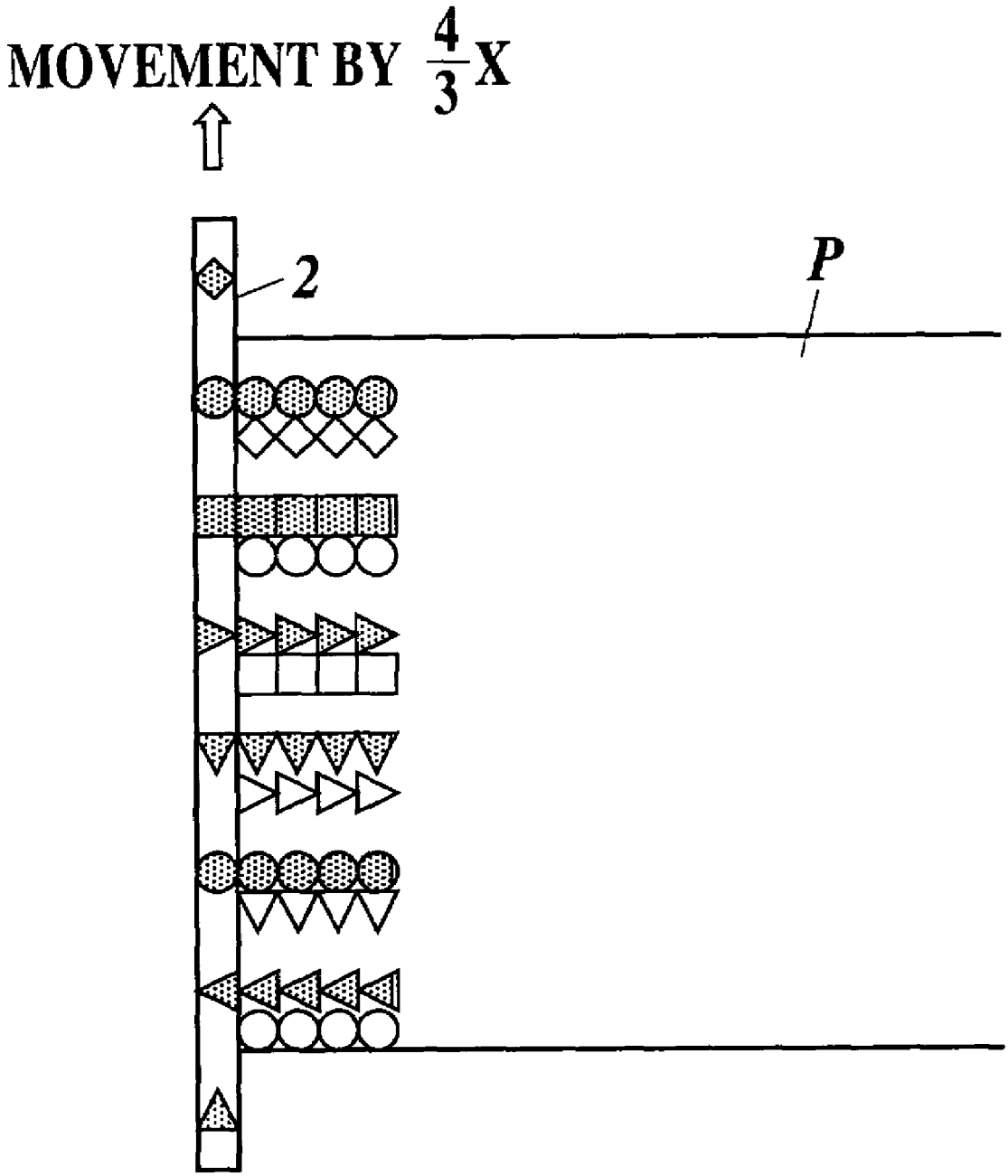
FIG. 14 is an illustration of the recording method in Embodiment 2.

Next, the recording head 2 is moved by the moving apparatus 5 by the distance (4/3)X toward the upper side in the nozzle arrangement direction in the drawing. Then, the second scanning is started in which the recording medium P is moved toward the upstream of the conveyance direction by "A" mm, thereby recording an image as shown in FIG. 14.

Figure 15:
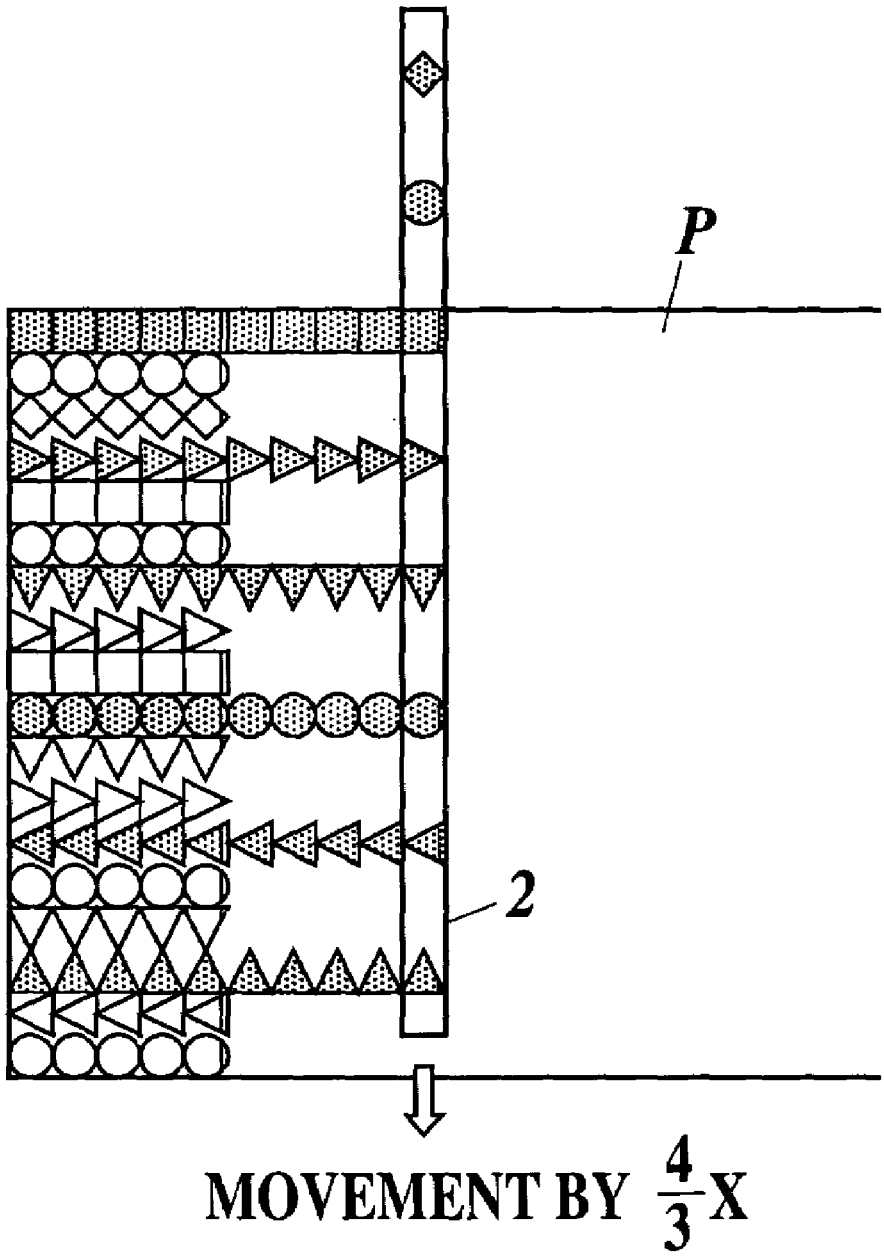
FIG. 15 is an illustration of the recording method in Embodiment 2.

Then, the recording head 2 is again moved, by distance (4/3)X, by the moving apparatus 5 toward the upper side in the nozzle arrangement direction of the drawing. Then, the third scanning is started in which the recording medium P is conveyed by "2A" mm toward the downstream of the conveyance direction, thereby recording an image as shown in FIG. 15. Thus, image recording of the part of "A" mm from the record-starting position is completed.

Figure 16:
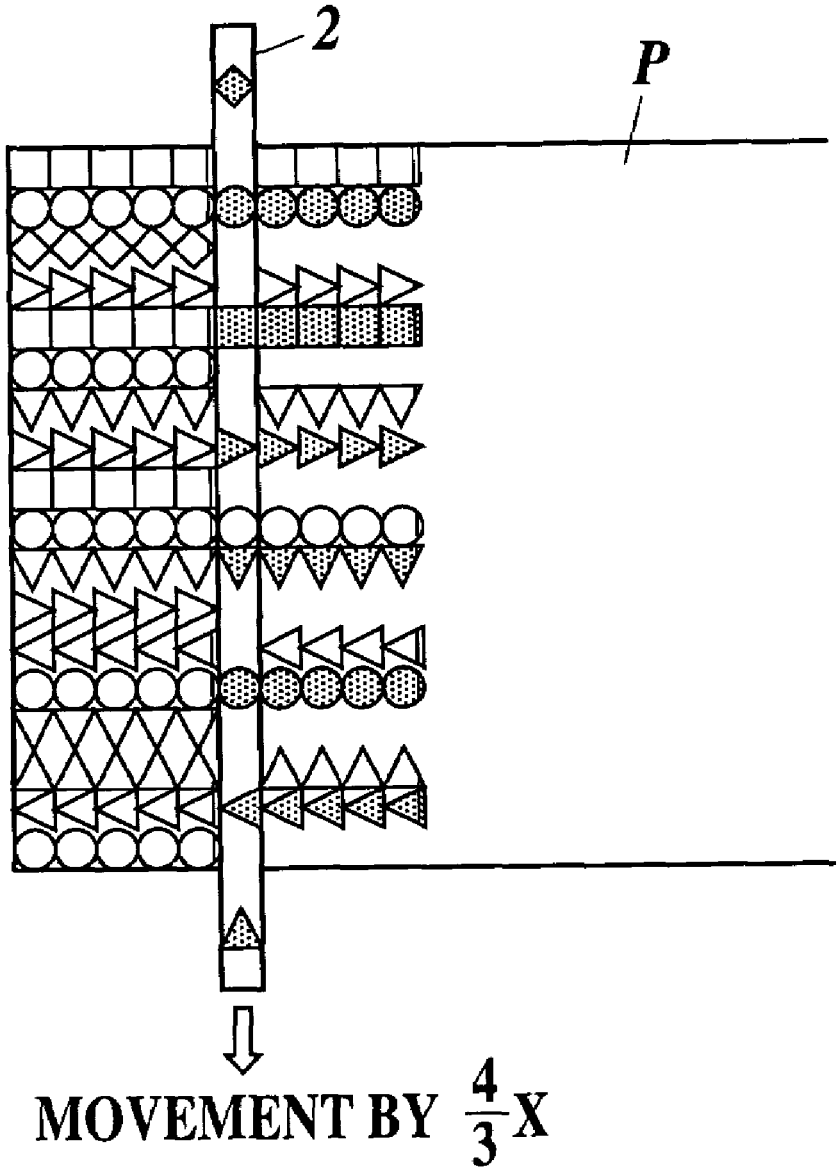
FIG. 16 is an illustration of the recording method in Embodiment 2.
Figure 17:
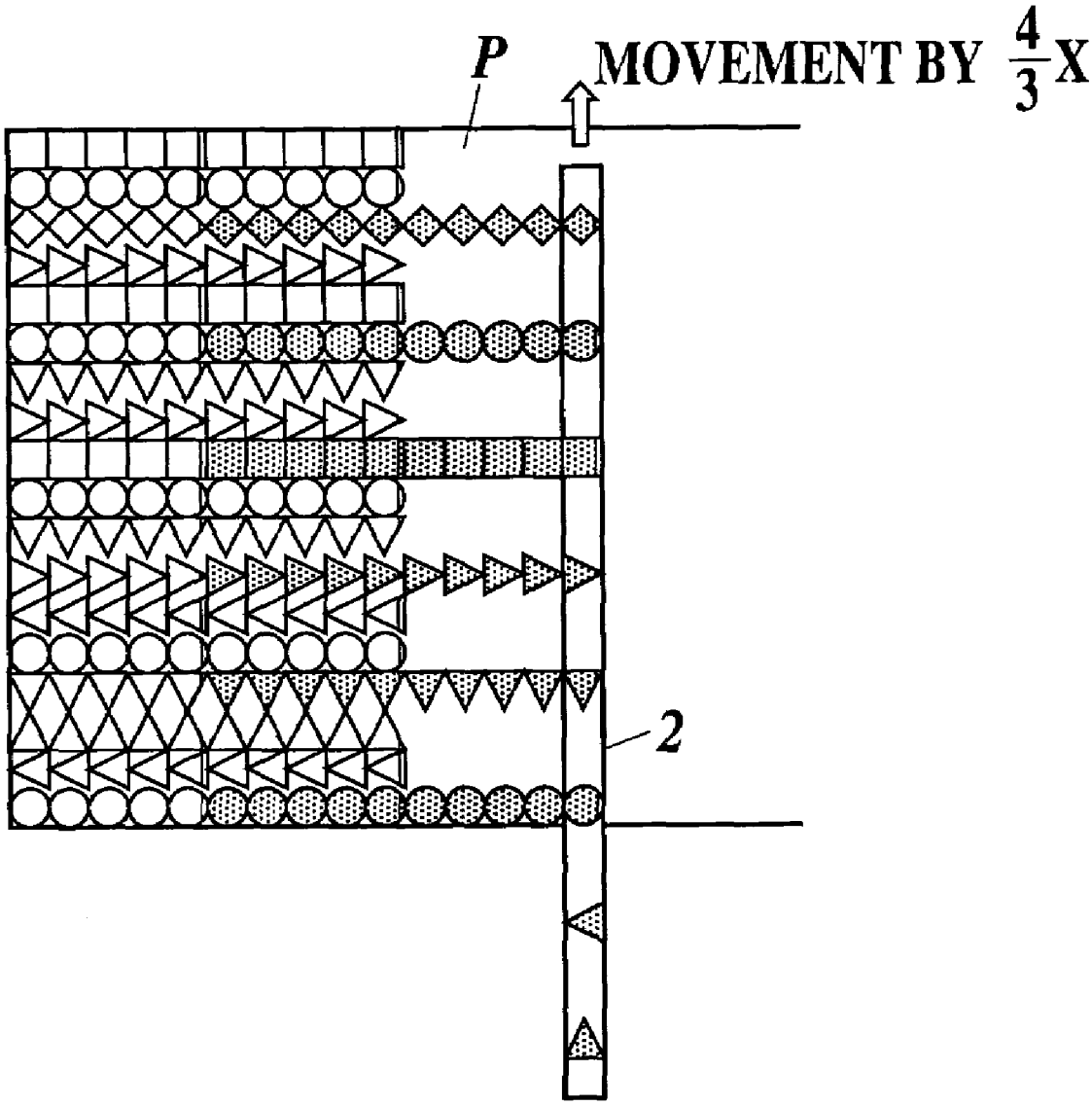
FIG. 17 is an illustration of the recording method in Embodiment 2.

Next, the recording head 2 is moved, by distance (4/3)X, by the moving apparatus 5 toward the lower side in the nozzle arrangement direction of the drawing. Then, the fourth scanning is started in which the recording medium P is conveyed, by "A" mm, to the upstream of the conveyance direction, thereby recording an image as shown in FIG. 16. Then, the recording head 2 is similarly moved to start the fifth scanning. In the fifth scanning, the recording medium P is moved, by "2A" mm, toward the downstream of the conveyance direction. As a result, an image recording of an additional amount of "A" mm as shown in FIG. 17 is completed.

Figure 18:
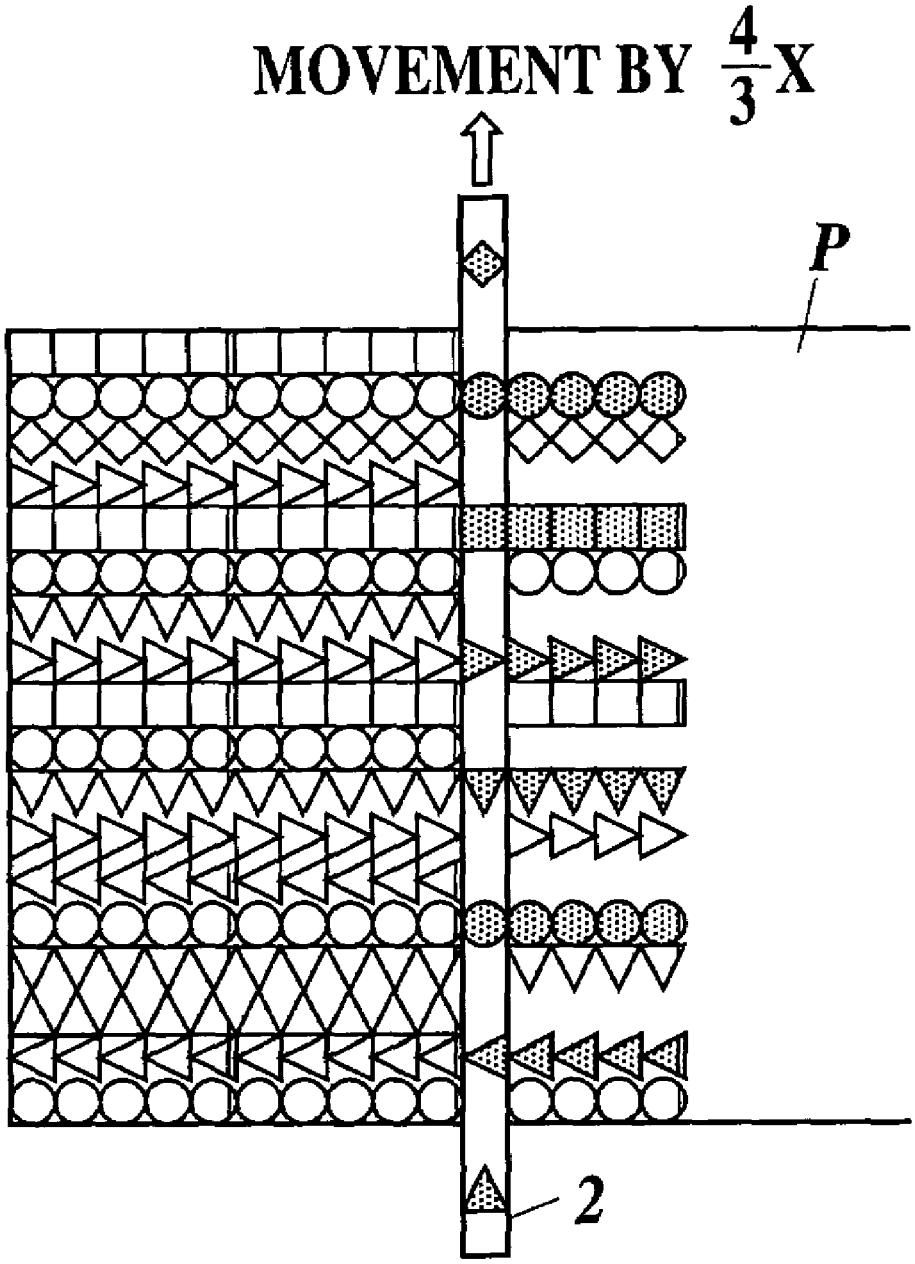
FIG. 18 is an illustration of the recording method in Embodiment 2.
Figure 19:
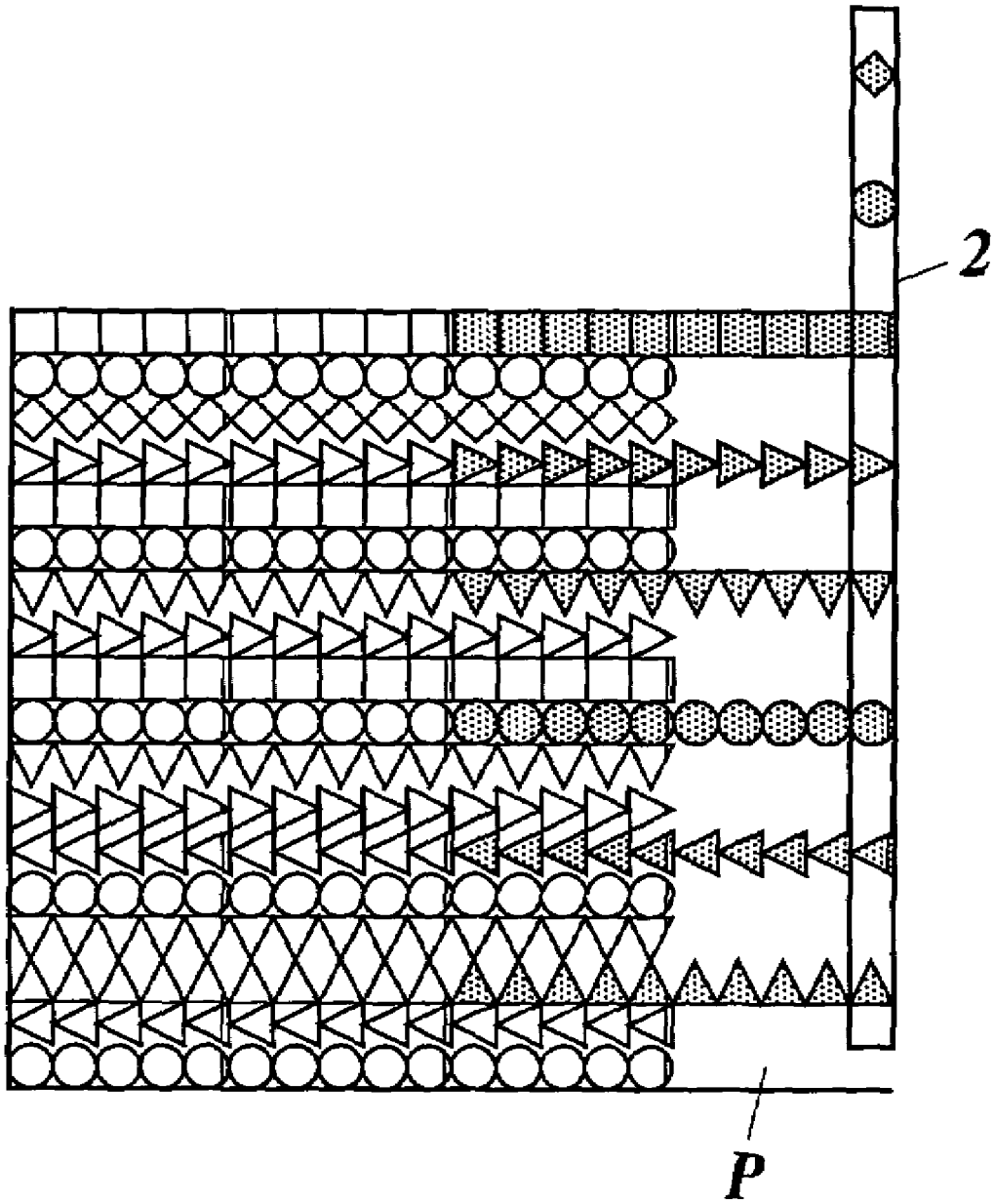
FIG. 19 is an illustration of the recording method in Embodiment 2.

Thereafter, whenever each scanning is completed, the movements of the recording head 2 being moved two times by (4/3)X toward the lower side in the nozzle arrangement direction of the drawing and then the same being moved two times by (4/3)X toward the upper side are repeated. Moreover, in each scanning, the movements of the recording medium P being moved by "A" mm toward the upstream of the conveyance direction and then the same being moved by "2A" mm toward the downstream of the conveyance direction are repeated. Thus, the recording head 2 and the recording medium P are recorded with the image shown in FIG. 18 when the sixth scanning is completed and are recorded with the image shown in FIG. 19 when the seventh scanning is completed.

As described above, the inkjet recording apparatus 1 of this embodiment not only provides the effect of Embodiment 1 but also provides an image recording with a resolution equal to or higher than the nozzle interval because, whenever a scanning is completed, the recording head 2 is moved, by a distance as a transfer unit obtained by multiplying the nozzle interval X with m/n ("m/n" in this embodiment is 4/3), in the nozzle arrangement direction. This embodiment also allows neighboring dots in the nozzle arrangement direction to be recorded by different nozzles. Thus, the stripe uneven recording along the conveyance direction can be dispersed to be unnoticeable.

Although this embodiment assumed the amount of the movement of the recording head 2 as (4/3)X, a recording with the resolution three times higher than that of the nozzle interval can be provided so long as the distance is (m/3)X("m" is a natural number coprime with 3). The larger the "m" is, the longer the distance between dots recorded by the same nozzle. Thus, stripe uneven recording along the conveyance direction is dispersed. However, there is a risk in which additional amount of nozzles of the recording head 2 may be required and the time for moving the recording head 2 is required and the position accuracy after the movement may be lowered. Thus, a control is provided so that "m" is within a range from 2 to 9 and is preferably within a range from 4 to 7.

Embodiment 3

Next, Embodiment 3 according to the present invention is described. An inkjet recording apparatus of Embodiment 3 has substantially the same structure as the inkjet recording apparatus 1 of Embodiment 1 except for a process for performing an image recording. As in Embodiment 2, the inkjet recording apparatus of Embodiment 3 is configured to provide an image recording so that dot thinning-out is not provided in the conveyance direction and the nozzle arrangement direction but the three scan interleave is provided. However, Embodiment 3 is different from Embodiment 2 only in that each component is controlled so that, at a position in the vicinity of a position at which the conveyance direction of the recording medium P is switched, the dot thinning-out is provided in the conveyance direction. Thus, regions other than the above position in the vicinity of the switching position are recorded by three scannings and the above position in the vicinity of the switching position is recorded by five scannings while providing a resolution equal to or higher than the nozzle interval of the recording head 2.

Hereinafter, each control configuration is described.

The control section 9 controls the moving apparatus 5 so that, whenever the conveyance direction of the recording medium P is switched, the recording head 2 is moved in the nozzle arrangement direction. The movement of the recording head 2 in this situation is the same as that in Embodiment 2.

The control section 9 controls the conveyance apparatus 4 so that the amount of the frontward movement of the recording medium P in the outward route is larger than the amount of the backward movement in the homeward route and so that the recording medium P is conveyed toward the downstream of the conveyance direction by an amount obtained by deducting, from the amount of the frontward movement in the outward route, the amount of the backward movement in the homeward route. When a part in the vicinity of a position at which the conveyance direction of the recording medium is switched is assumed to have a size of "B" mm corresponding to four dots, a control is provided so that the recording medium P has a backward movement by "(A+B)" mm in an even numbered scanning other than the second scanning and so that the recording medium P has a frontward movement by "(2A+B)" mm in an odd numbered scanning other than the first scanning and the third scanning, thereby conveying the recording medium P in a stepwise manner by "A" mm, which is obtained by deducting "(A+B)" from "(2A+B)".

When the switching part of "B" mm is recorded, the head driving section 11 controls the recording head 2 so that the dot thinning-out is performed along the conveyance direction. Specifically, in each scanning after the fourth scanning, the parts having a distance of "B" mm from the record-starting position and the record-completed position are recorded with dots along the conveyance direction so that one dot is skipped and the next one dot is recorded.

Next, the operation of the inkjet recording apparatus in this embodiment is described.

It is noted that, for convenience, this embodiment assumes that all nozzles in the recording head 2 are not clogged.

Figure 20:
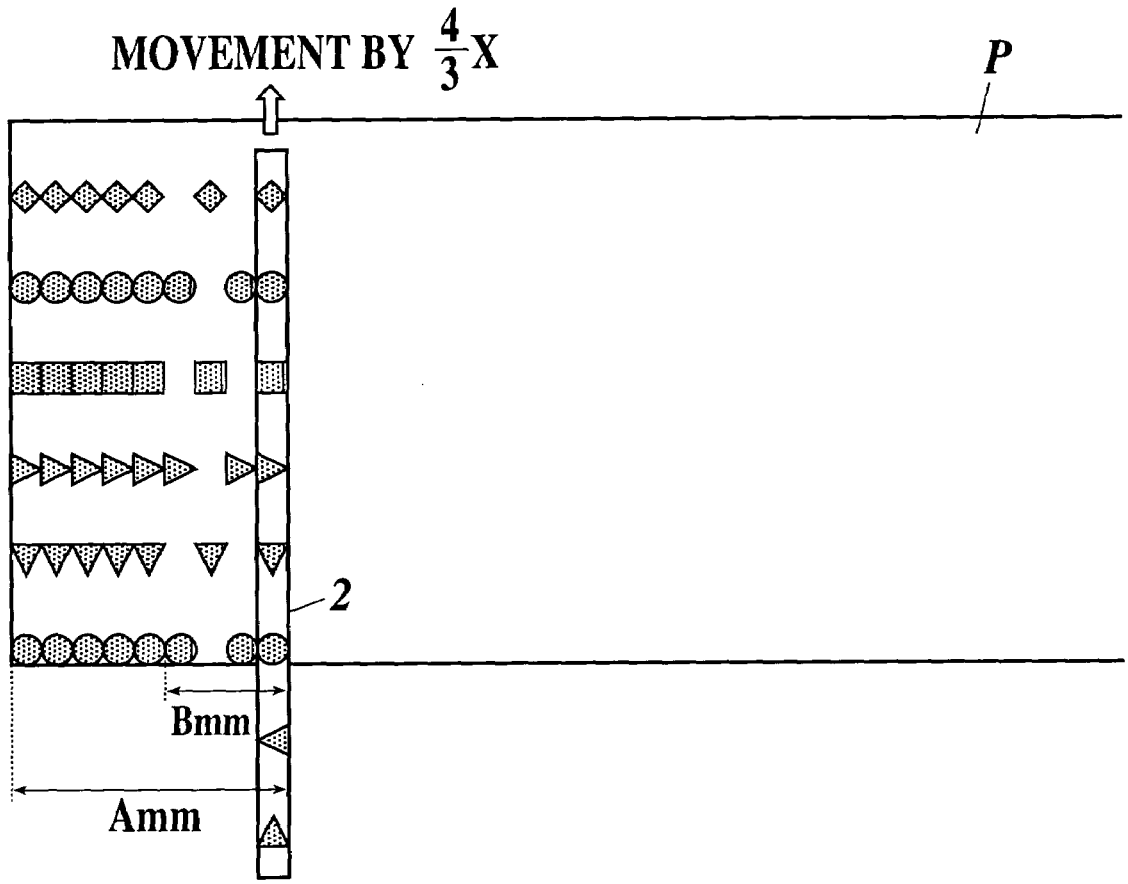
FIG. 20 is an illustration of a recording method in Embodiment 3.

First, the control section 9 is inputted with predetermined information regarding a to-be-recorded image. Then, the recording head 2 and the recording medium P are moved to a predetermined position. Thereafter, the first scanning is started in which the recording medium P is conveyed to the downstream of the conveyance direction by "A" mm. When recording from the record-completed position of the first scanning to the downstream of the conveyance direction by "B" mm, the recording head 2 performs the dot thinning-out to form dots in the conveyance direction so that one dot is skipped and the next one dot is recorded, thereby recording an image as shown in FIG. 20.

Figure 21:
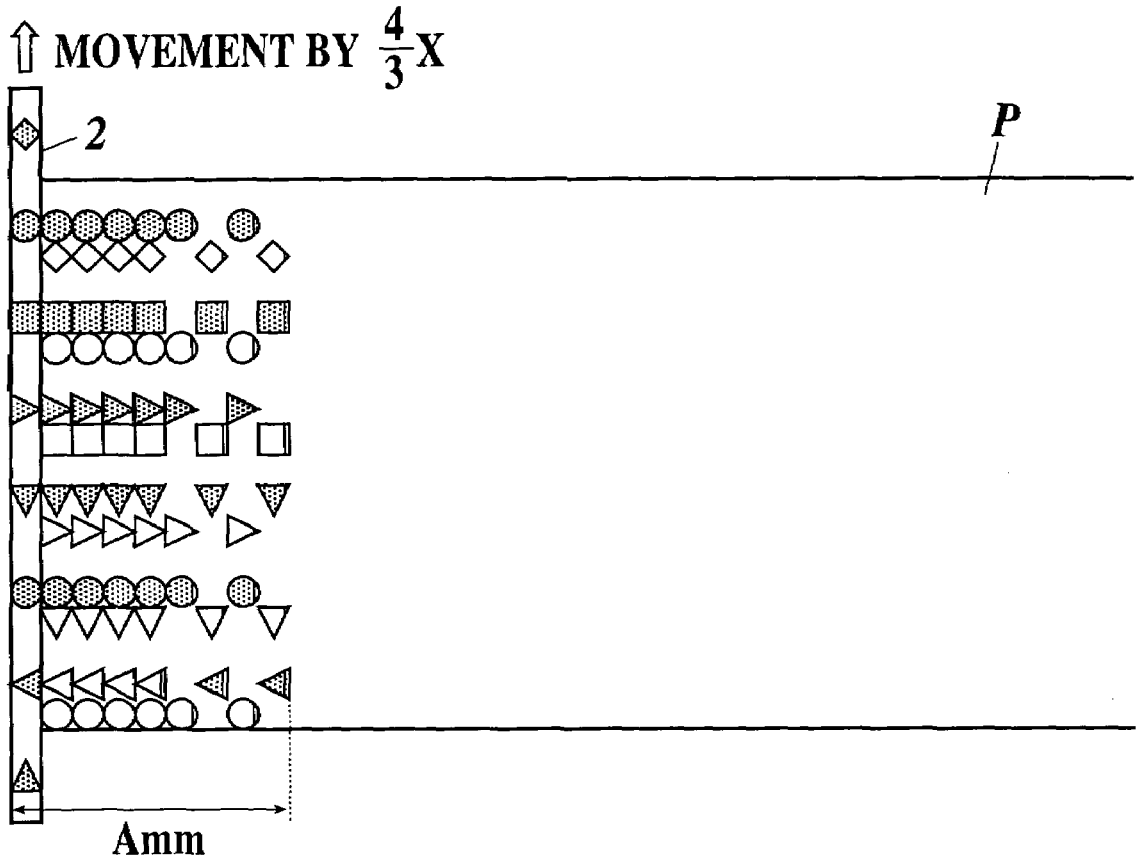
FIG. 21 is an illustration of the recording method in Embodiment 3.

Then, the recording head 2 is moved, by the distance of (4/3)X, by the moving apparatus 5 to the upside of the nozzle arrangement direction in the drawing. Then, the second scanning is started in which the recording medium P is conveyed by "A" mm to the upstream of the conveyance direction, thereby recording an image as shown in FIG. 21. Then, a part from the record-starting position of the second scanning to the upstream of the conveyance direction by "B" mm is subjected to the dot thinning-out so that one dot is skipped and the next one dot is recorded.

Figure 22:
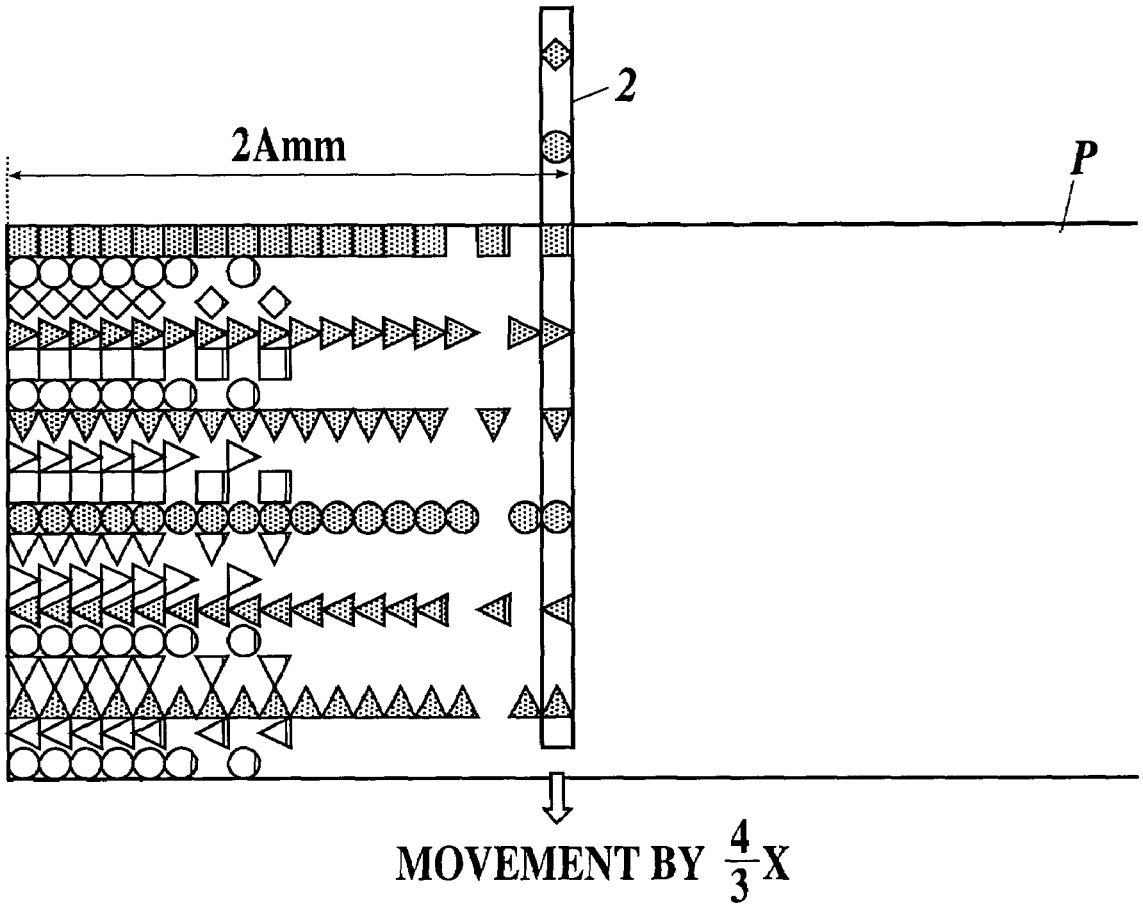
FIG. 22 is an illustration of the recording method in Embodiment 3.

Next, the recording head 2 is again moved, by distance of (4/3)X, by the moving apparatus 5 to the upside of the nozzle arrangement direction in the drawing. Then, the third scanning is started in which the recording medium P is conveyed, by "2A" mm, to the downstream of the conveyance direction, thereby recording an image as shown in FIG. 22. When recording a part of "B" mm from the record-completed position of the third scanning to the downstream of the conveyance direction, the part is subjected to the dot thinning-out in the conveyance direction so that one dot is skipped and the next one dot is recorded.

Figure 23:
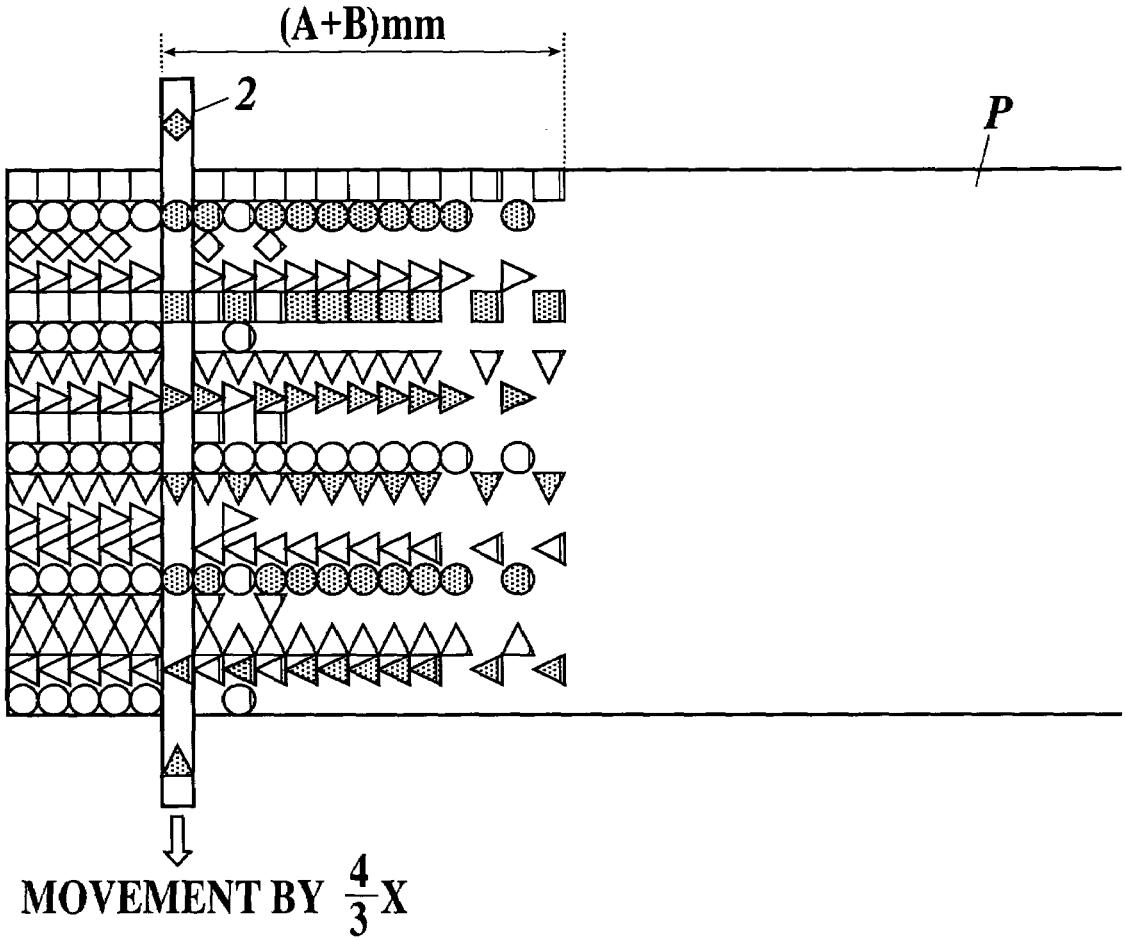
FIG. 23 is an illustration of the recording method in Embodiment 3.

Thereafter, the recording head 2 is moved, by the distance of (4/3)X, by the moving apparatus 5 to the lower side in the nozzle arrangement direction in the drawing. Then, the fourth scanning is started in which the recording medium P is moved, by "(A+B)"mm, to the upstream of the conveyance direction, thereby recording an image as shown in FIG. 23. In this recording, when recording a part of "B" mm from the record-starting position of the fourth scanning to the upstream of the conveyance direction, the part is subjected to the dot thinning-out in the conveyance direction so that one dot is skipped and the next one dot is recorded. Further, a region of "B" mm from the record-completed position of the fourth scanning to the upstream of the conveyance direction is a region that was recorded with the dot thinning-out at the start of the second scanning. Thus, by being subjected by the fourth scanning to the dot thinning-out to record an image, the recording of the part of "B" mm from the position at which the conveyance direction is switched is completed.

Figure 24:
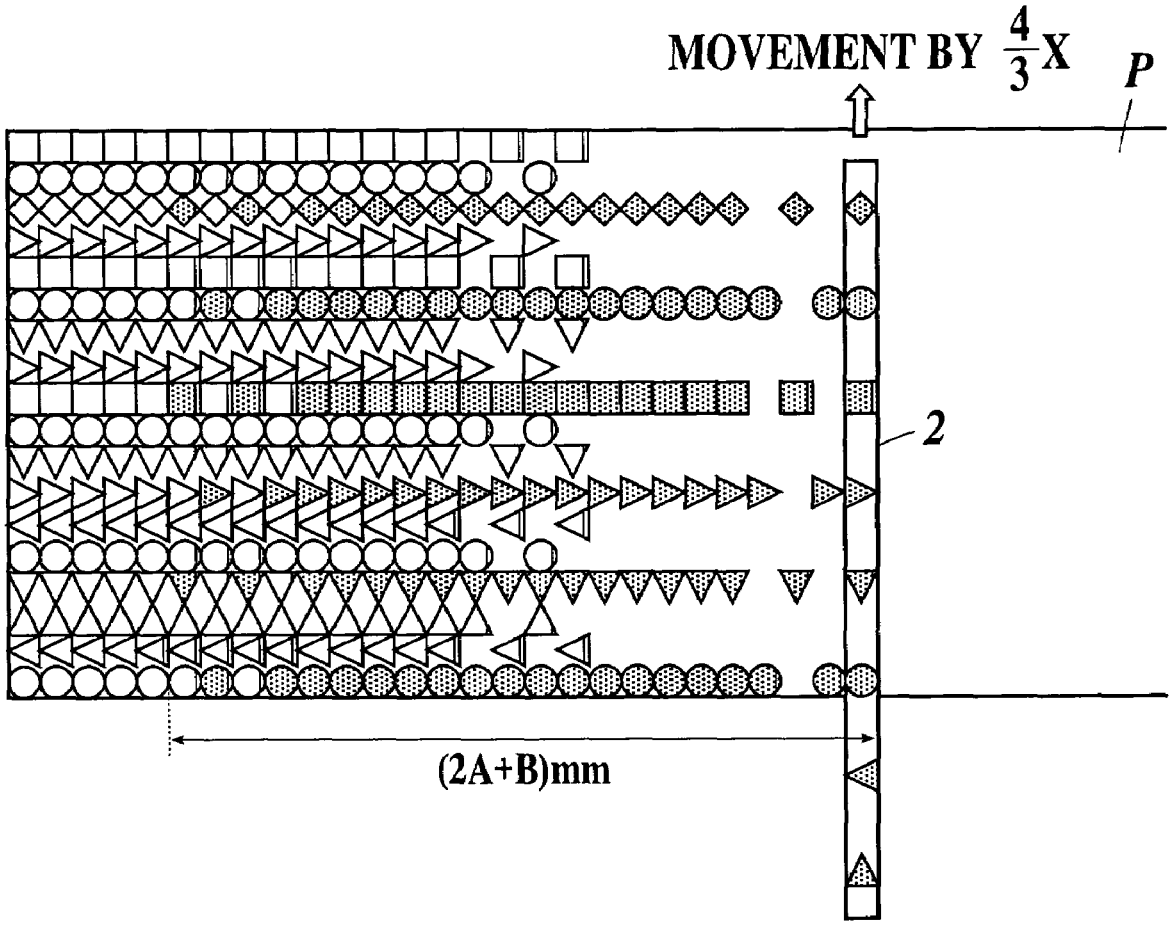
FIG. 24 is an illustration of the recording method in Embodiment 3.

Then, the recording head 2 is similarly moved to start the fifth scanning. In the fifth scanning, the recording medium P is conveyed, by "(2A+B)"mm, to the downstream of the conveyance direction, thereby recording an image. Then, the image recording to the part of "A" mm from the record-starting position is completed as shown in FIG. 24.

Figure 25:
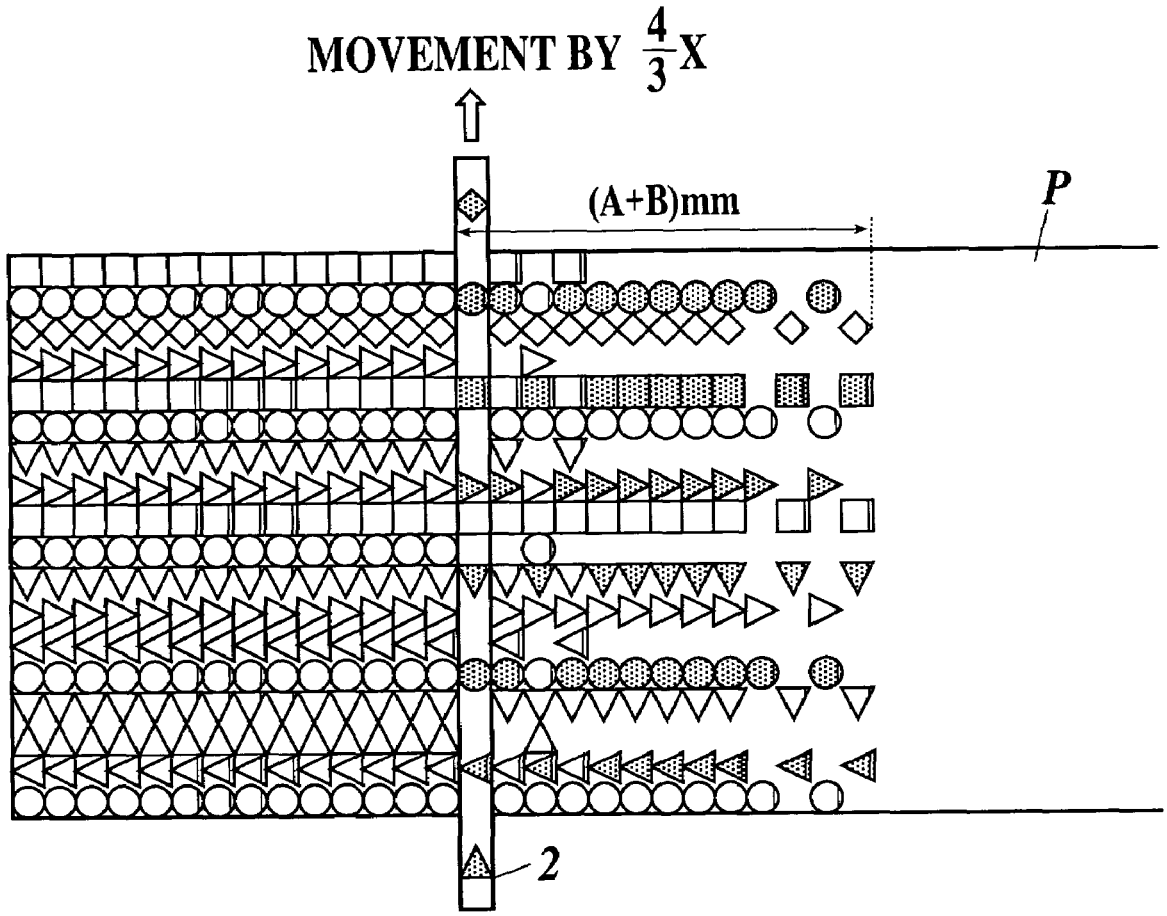
FIG. 25 is an illustration of the recording method in Embodiment 3.
Figure 26:
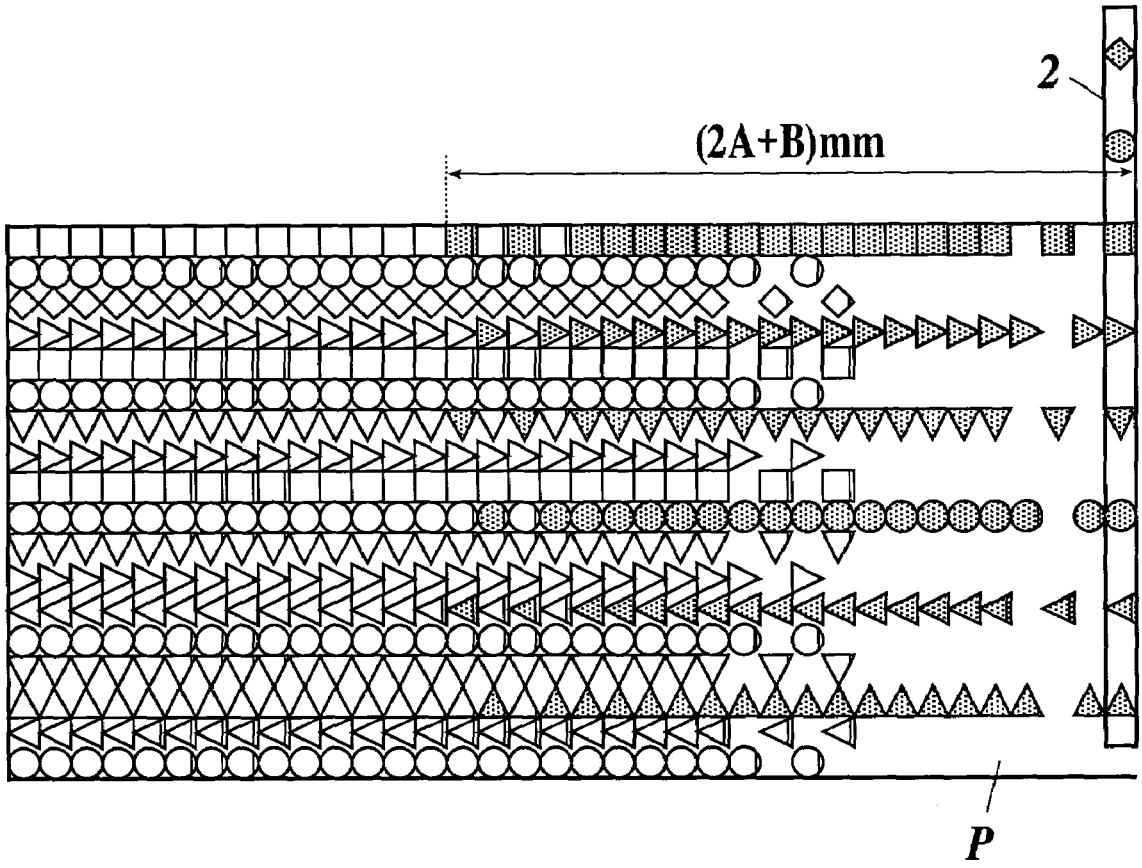
FIG. 26 is an illustration of the recording method in Embodiment 3.

Thereafter, whenever each scanning is completed, the recording head 2 is repeatedly moved with a cycle in which the recording head 2 is moved two times by 4/3X to the lower side of the nozzle arrangement direction in the drawing and is moved two times by 4/3X to the upper side. Moreover, the recording medium P is repeatedly conveyed with a cycle in which the recording medium P is conveyed by "(A+B)"mm, in an even numbered scanning, to the upstream of the conveyance direction and is conveyed by "(2A+B)"mm, in an odd numbered scanning, to the downstream of the conveyance direction. Furthermore, in each scanning, the recording head 2 carries out the dot thinning-out in the conveyance direction for the regions "B" mm at the record-starting position and the record-completed position so that one dot is skipped and the next one dot is recorded. Thus, when the sixth scanning is completed, the recording head 2 and the recording medium P are recorded with the image shown in FIG. 25. When the seventh scanning is completed, the recording head 2 and the recording medium P are recorded with the image shown in FIG. 26.

As described above, the inkjet recording apparatus 1 of this embodiment provides not only the effect of Embodiment 1 but also moves, when the scanning is completed, the recording head 2, by a distance as a transfer unit obtained by multiplying the nozzle interval with 4/3, in the nozzle arrangement direction. Thus, an image recording having a resolution equal to or higher than the nozzle interval can be performed. Furthermore, neighboring dots in the nozzle arrangement direction can be recorded by different nozzles, thus dispersing stripe uneven recording in the conveyance direction to an unnoticeable level.

Furthermore, neighboring dots in the nozzle arrangement direction at a part of "B" mm from the position at which the conveyance direction of the recording medium P is switched are recorded by different nozzles. Thus, stripe uneven recording in the nozzle arrangement direction due to an error in the conveyance of the recording medium can be prevented while providing an image recording securely. Furthermore, a part of "B" mm from the position at which the conveyance direction of the recording medium P is switched is subjected to the dot thinning-out while being recorded. Thus, stripe uneven recording in the nozzle arrangement direction due to an error in the conveyance of the recording medium can be prevented securely.

Embodiment 4

Next, Embodiment 4 according to the present invention is described. The inkjet recording apparatus of this embodiment has substantially the same structure as the inkjet recording apparatus 1 of Embodiment 1 except for a process for performing an image recording. As in Embodiment 2, the inkjet recording apparatus of Embodiment 4 controls each component so that dot thinning-out is not provided in the conveyance direction and the nozzle arrangement direction but a five scan interleave is provided in which an image of a predetermined region is recorded by five scannings to provide a resolution equal to or higher than the nozzle interval of the recording head 2. This embodiment includes the no-jet nozzle 14 that is detected by the no-jet detection mechanism 15.

Hereinafter, the respective control configurations are described.

The control section 9 controls the moving apparatus 5 so that, whenever the conveyance direction of the recording medium P is switched, the recording head 2 is moved in the nozzle arrangement direction. When the distance Y is defined as a value obtained by dividing the nozzle interval X by 2, the amount of the movement of the recording head 2 is 3Y, 4Y, 5Y, and 6Y in this order and the movement by these amounts are repeated in this order. The recording head 2 is repeatedly moved with a cycle in which the recording head 2 is moved repeatedly by the respective distances 3Y to 6Y to the lower side of the nozzle arrangement direction in the drawing and is moved repeatedly by the respective distances 3Y to 6Y to the upper side of the nozzle arrangement direction.

The control section 9 controls the conveyance apparatus 4 so that the amount of the frontward movement of the recording medium P in the outward route is larger than the amount of the backward movement in the homeward route and so that the recording medium P is conveyed toward the downstream of the conveyance direction by an amount obtained by deducting, from the amount of the frontward movement in the outward route, the amount of the backward movement in the homeward route. Specifically, the recording medium P is moved by "A" mm in the first scanning and the second scanning, is moved backward by "2A" mm in the third scanning and even numbered scannings after the fourth scanning, and is moved by "3A" mm in the frontward direction in odd numbered scannings after the fifth scanning. Thus, the control section 9 controls the conveyance apparatus 4 so that the recording medium P is moved by "A" mm that is the difference among the above three distances.

Next, the operation of the inkjet recording apparatus in this embodiment is described.

In this embodiment, one no-jet nozzle 14 is detected by the no-jet detection mechanism 15.

Figure 27:
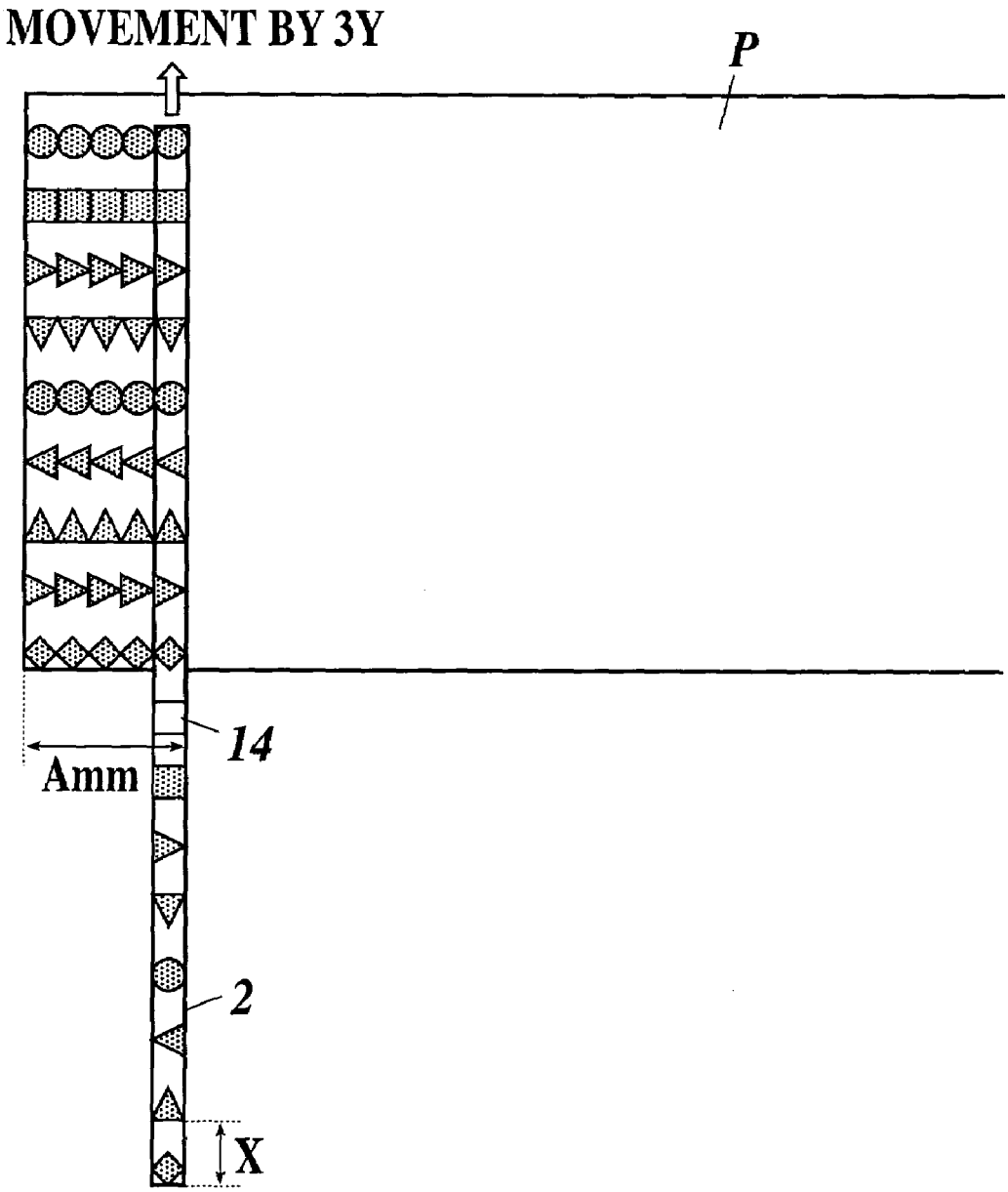
FIG. 27 is an illustration of a recording method in Embodiment 4.

First, the control section 9 is inputted with predetermined information regarding a to-be-recorded image. Then, the recording head 2 and the recording medium P are moved to a predetermined position. Thereafter, the first scanning is started in which the recording medium P is conveyed to the downstream of the conveyance direction by "A" mm, thereby recording an image as shown in FIG. 27. In this situation, the no-jet nozzle 14 is not opposed to the recording medium, thus allowing the recording medium P to be recorded with all of the predetermined images.

Figure 28:
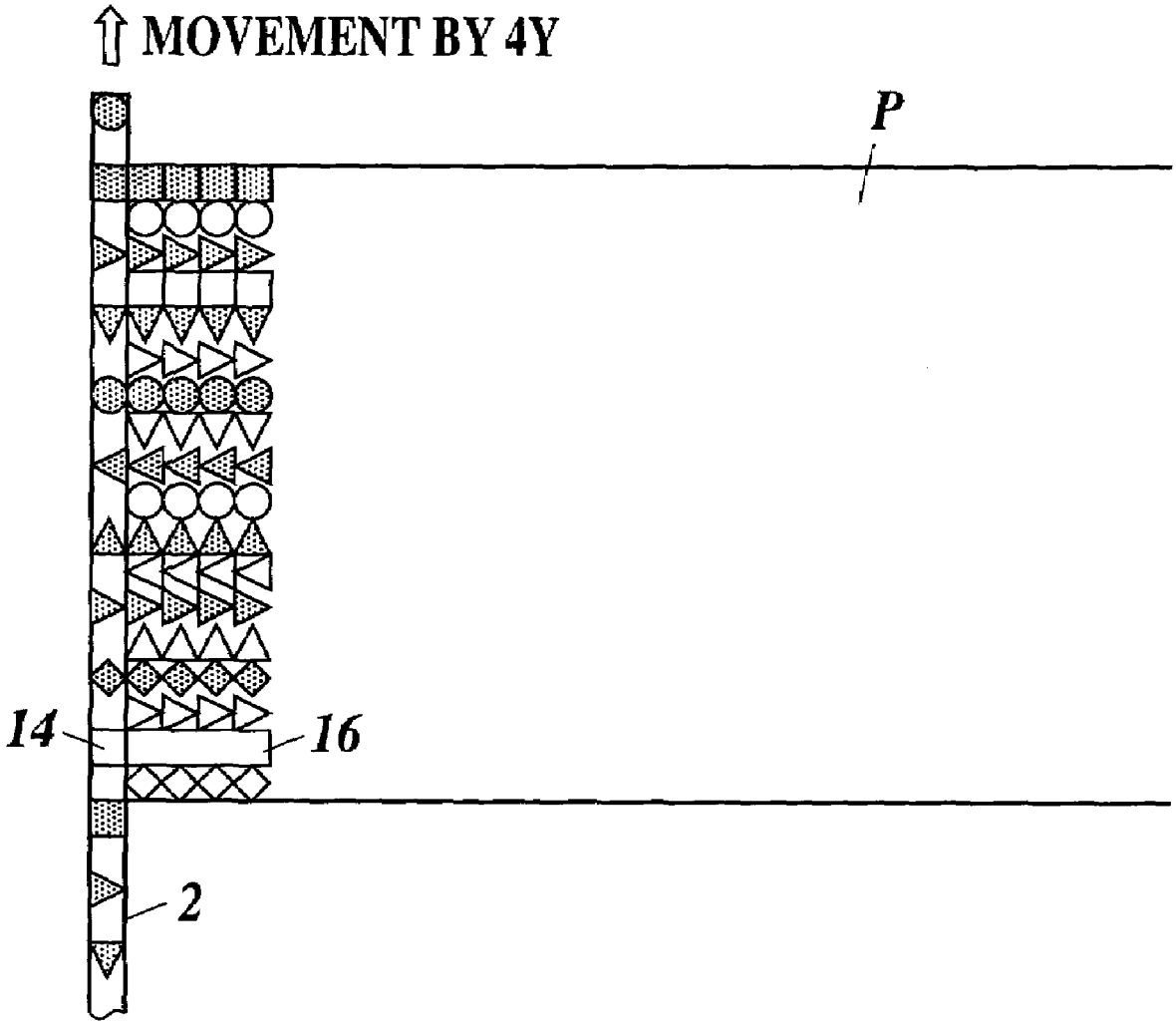
FIG. 28 is an illustration of the recording method in Embodiment 4.

Next, the recording head 2 is moved, by distance 3Y, by the moving apparatus 5 to the upside of the nozzle arrangement direction of the drawing. Then, the second scanning is started in which the recording medium P is conveyed, by "A" mm, to the upstream of the conveyance direction, thereby recording an image as shown in FIG. 28. FIG. 28 shows the recording head 2 and the recording medium P after the second scanning. During the scanning, a region opposed to the no-jet nozzle 14 is the no-ink-jet region 16.

Figure 29:
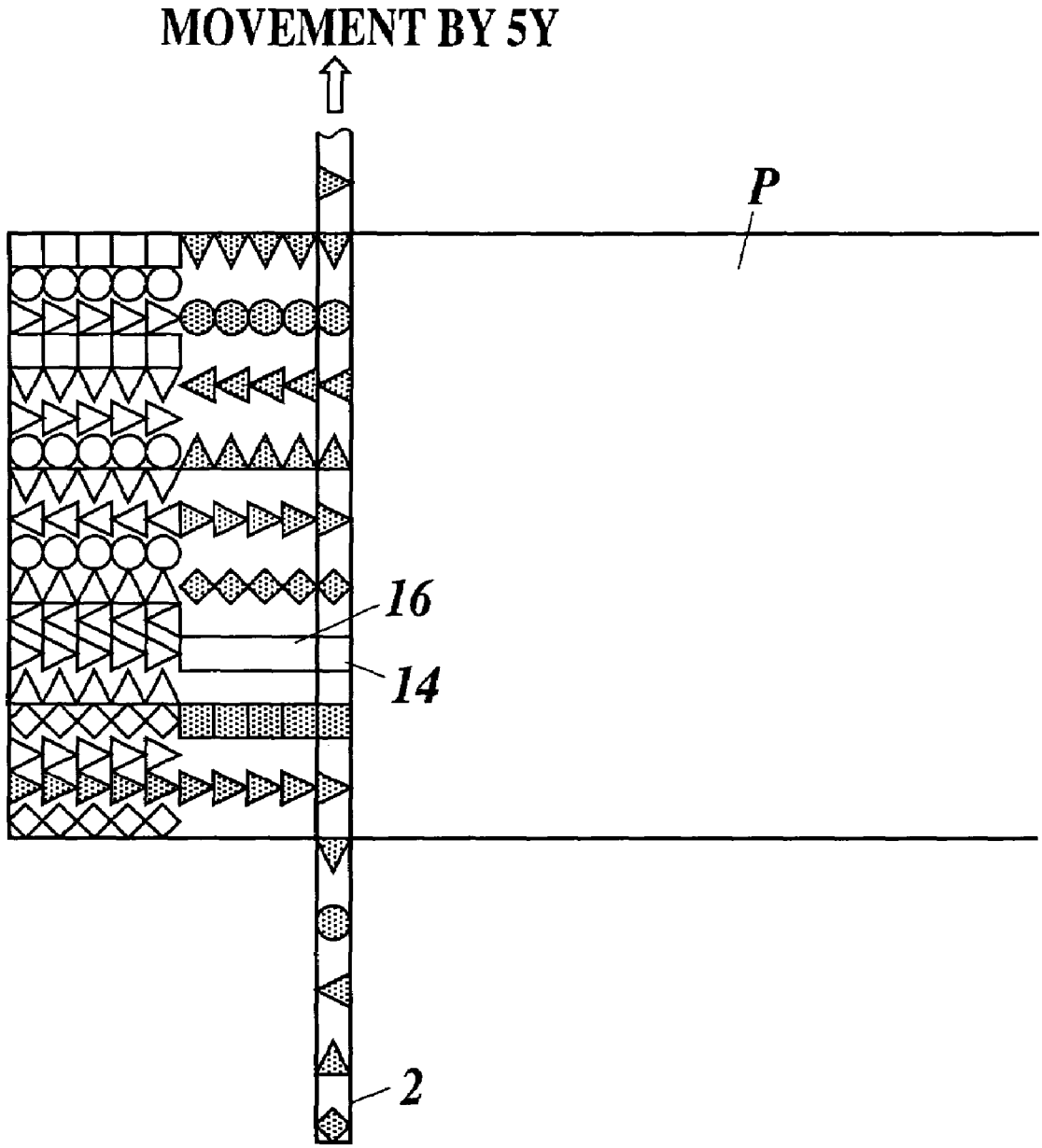
FIG. 29 is an illustration of the recording method in Embodiment 4.

Then, the recording head 2 is again moved, by the distance 4Y, by the moving apparatus 5 to the upside of the nozzle arrangement direction of the drawing. Then, the third scanning is started in which the recording medium P is conveyed, by "2A" mm, to the downstream of the conveyance direction, thereby recording an image as shown in FIG. 29. Then, a nozzle opposed to the no-ink-jet region 16 generated in the second scanning jets ink to record the no-ink-jet region 16. The third scanning also causes the recording medium P to be opposed to the no-jet nozzle 14, generating the no-ink-jet region 16.

Figure 30:
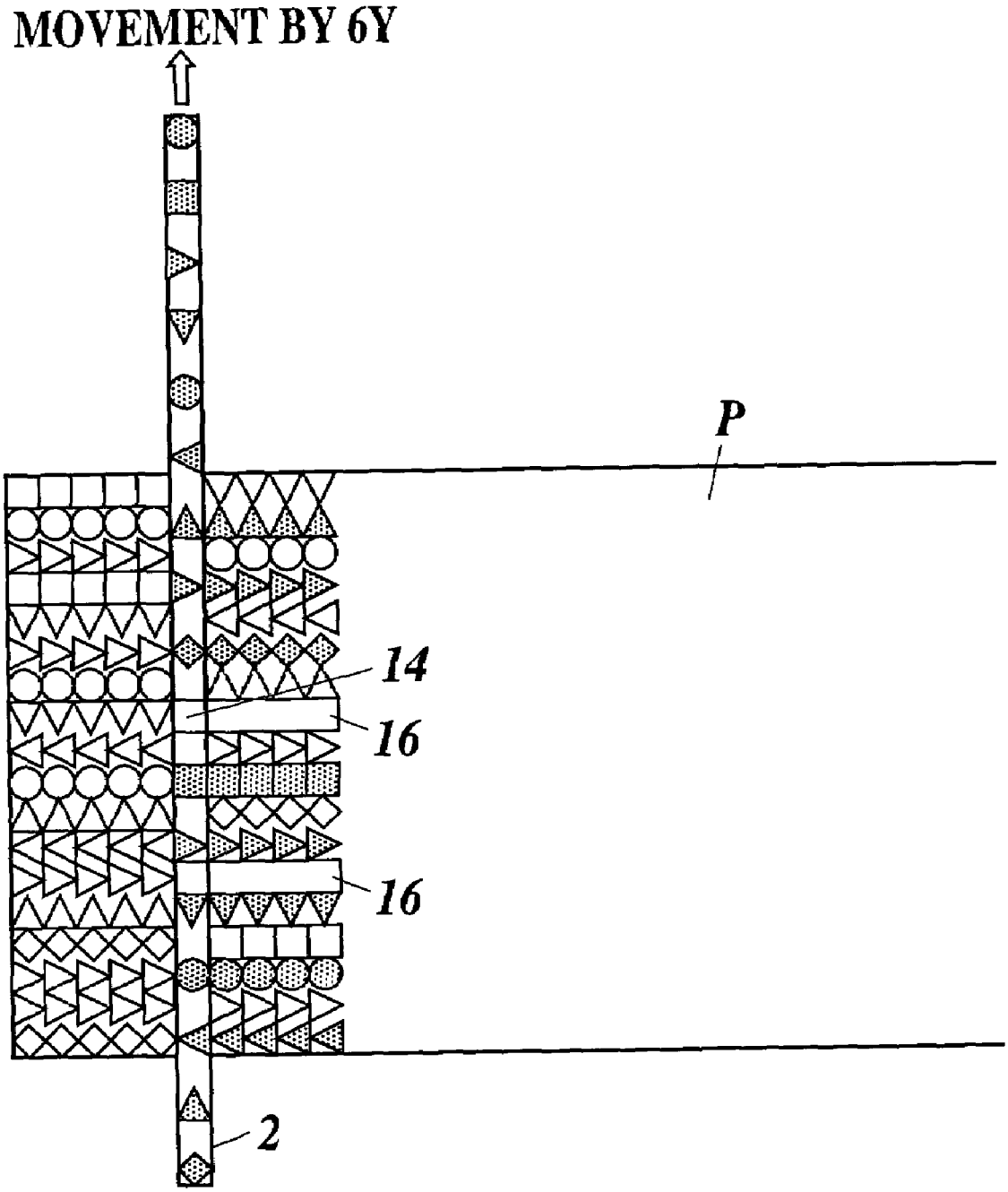
FIG. 30 is an illustration of the recording method in Embodiment 4.

Thereafter, the recording head 2 is moved, by the distance 5Y, by the moving apparatus 5 to the upside of the nozzle arrangement direction of the drawing. Then, the fourth scanning is started in which the recording medium P is conveyed, by "A" mm, to the upstream of the conveyance direction, thereby recording an image as shown in FIG. 30. The fourth scanning also causes the recording medium P to be opposed to the no-jet nozzle 14, generating the no-ink-jet region 16.

Figure 31:
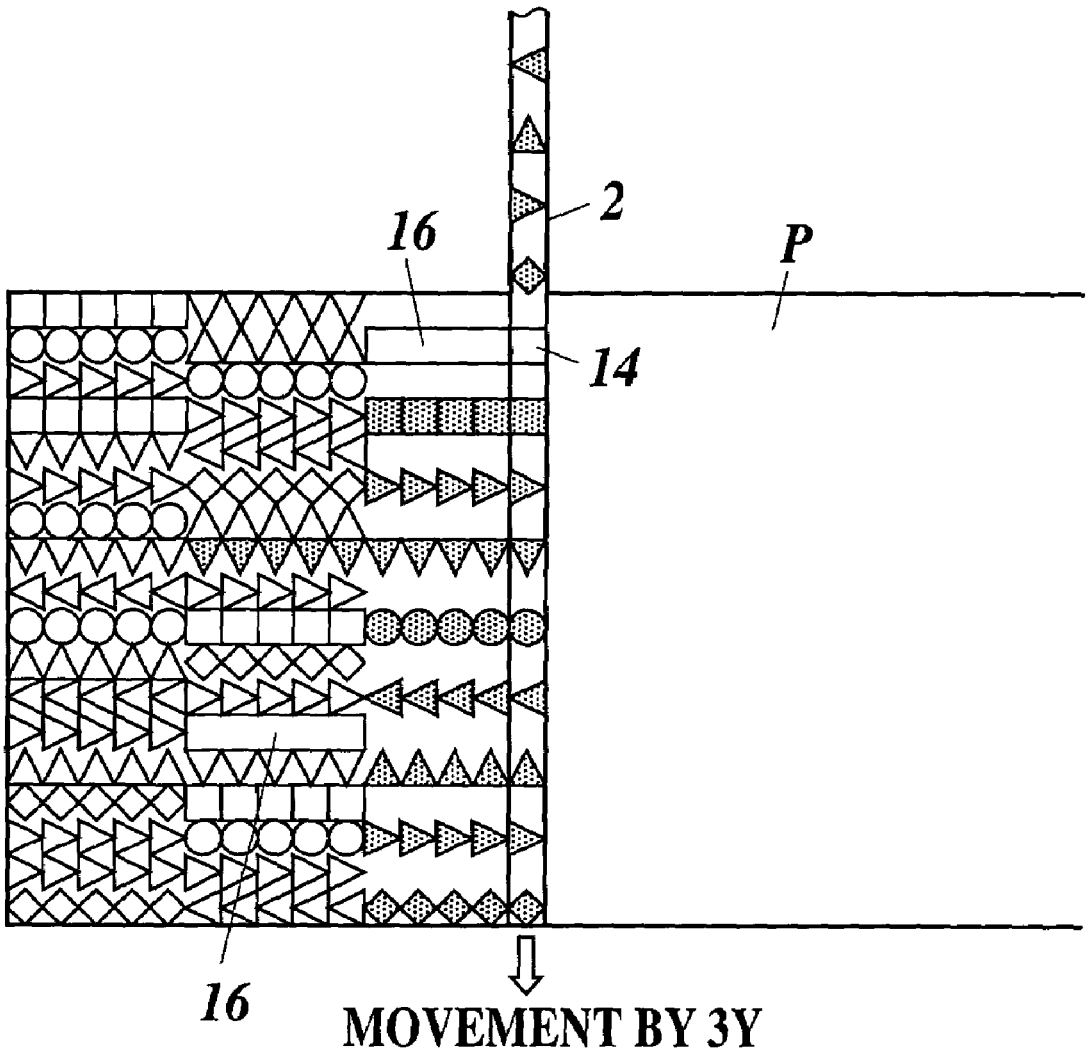
FIG. 31 is an illustration of the recording method in Embodiment 4.

The recording head 2 is further moved, by the distance 6Y, by the moving apparatus 5 to the upside of the nozzle arrangement direction of the drawing, thereby starting the fifth scanning. In the fifth scanning, the recording medium P is conveyed, by "2A" mm, to the downstream of the conveyance direction, providing a status as shown in FIG. 31. Then, a nozzle opposed to the no-ink-jet region 16 that was generated in the fourth scanning jets ink, thus recording the no-ink-jet region 16.

Figure 32:
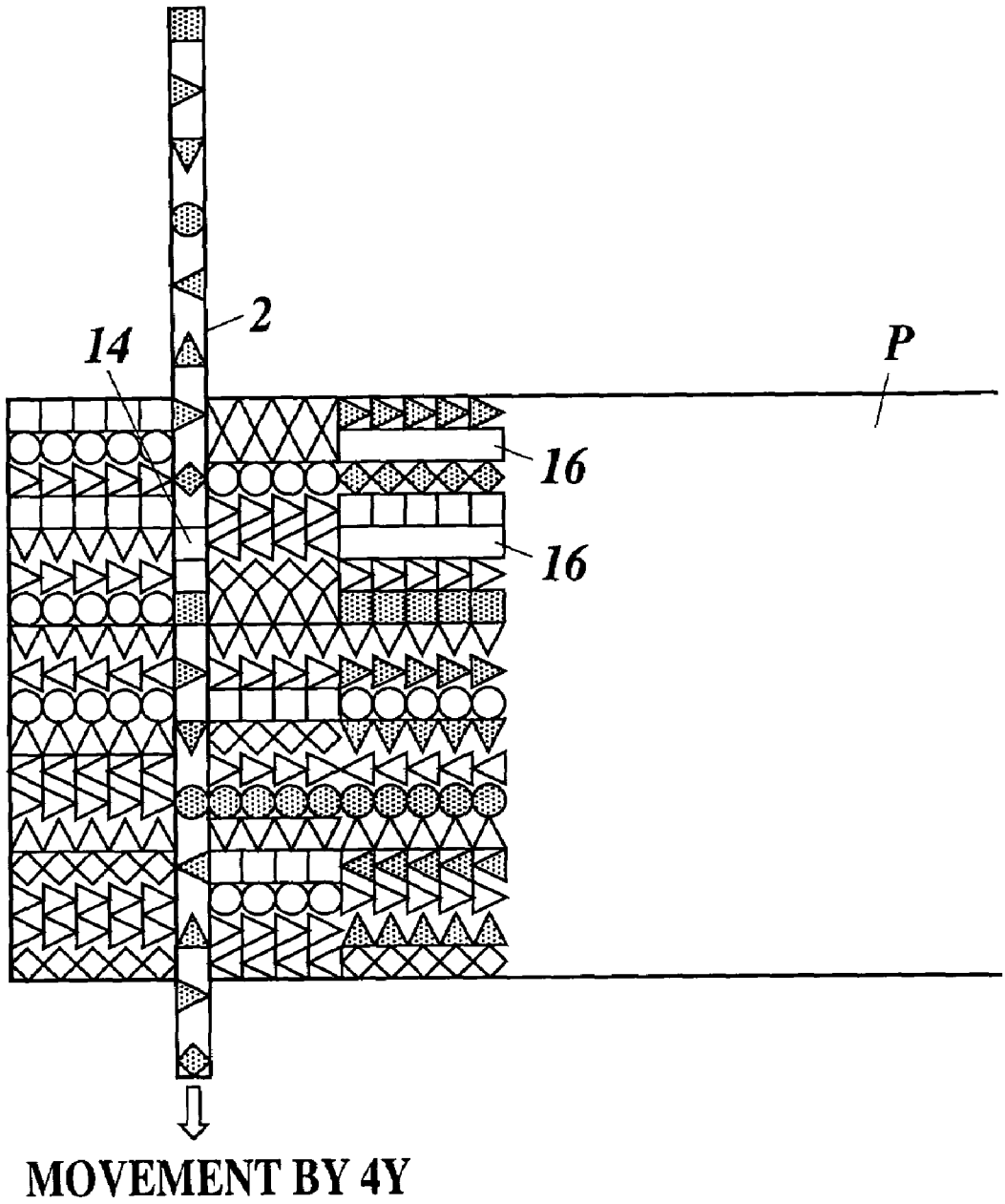
FIG. 32 is an illustration of the recording method in Embodiment 4.

Next, the recording head 2 is moved, by the distance 3Y, by the moving apparatus 5 to the lower side of the nozzle arrangement direction of the drawing. Then, the sixth scanning is started in which the recording medium P is conveyed, by "2A" mm, to the upstream of the conveyance direction, thereby recording an image as shown in FIG. 32. The sixth scanning also causes the recording medium P to be opposed to the no-jet nozzle 14, generating the no-ink-jet region 16. A nozzle opposed to the no-ink-jet region 16 that was generated in the third scanning jets ink, thus recording the no-ink-jet region 16.

Figure 33:
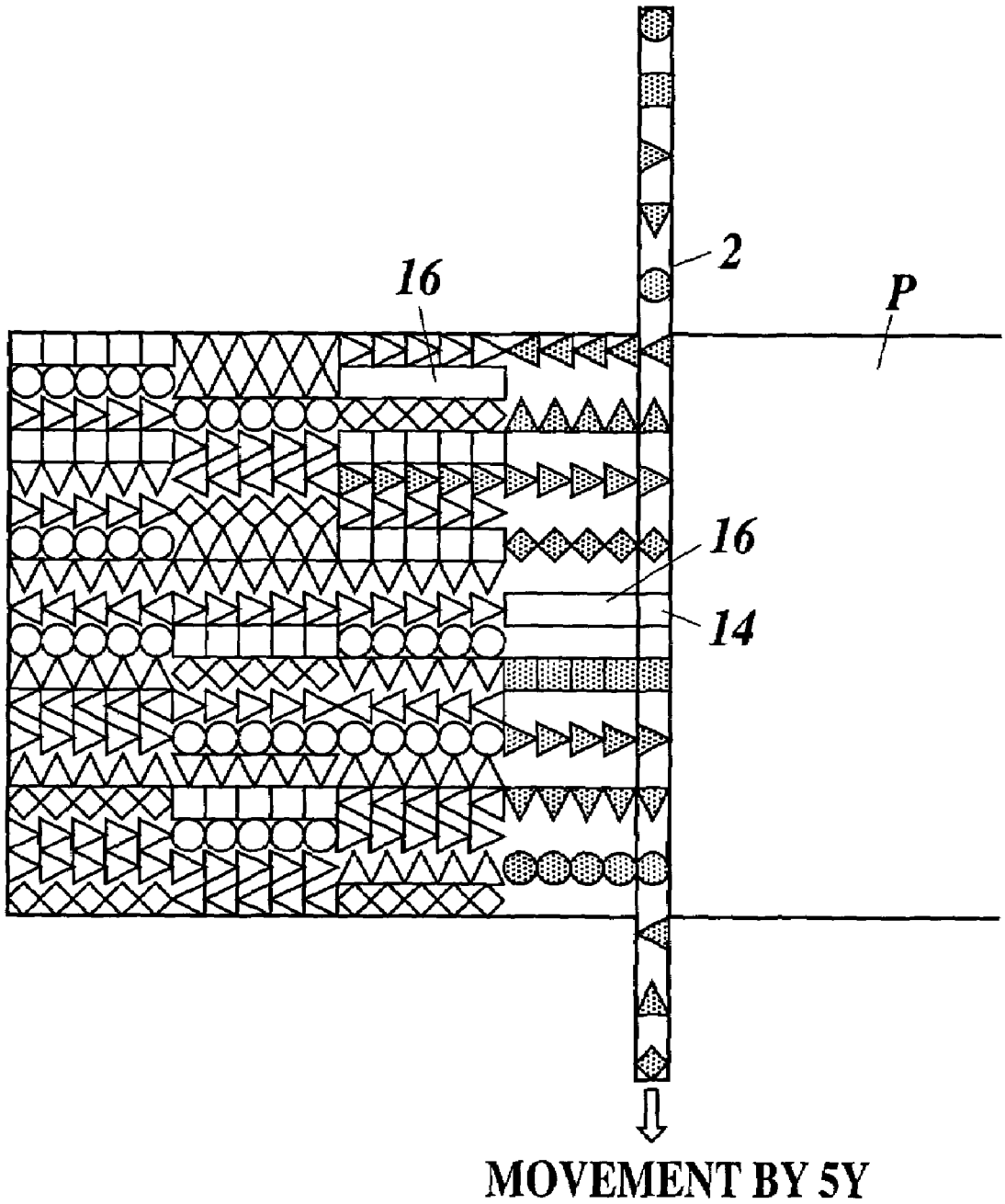
FIG. 33 is an illustration of the recording method in Embodiment 4.

Next, the recording head 2 is moved, by the distance 4Y, by the moving apparatus 5 to the lower side of the nozzle arrangement direction of the drawing. Then, the seventh scanning is started in which the recording medium P is conveyed, by "3A" mm, to the downstream of the conveyance direction, thereby recording an image as shown in FIG. 33. The seventh scanning also causes the recording medium P to be opposed to the no-jet nozzle 14, generating the no-ink-jet region 16.

Figure 34:
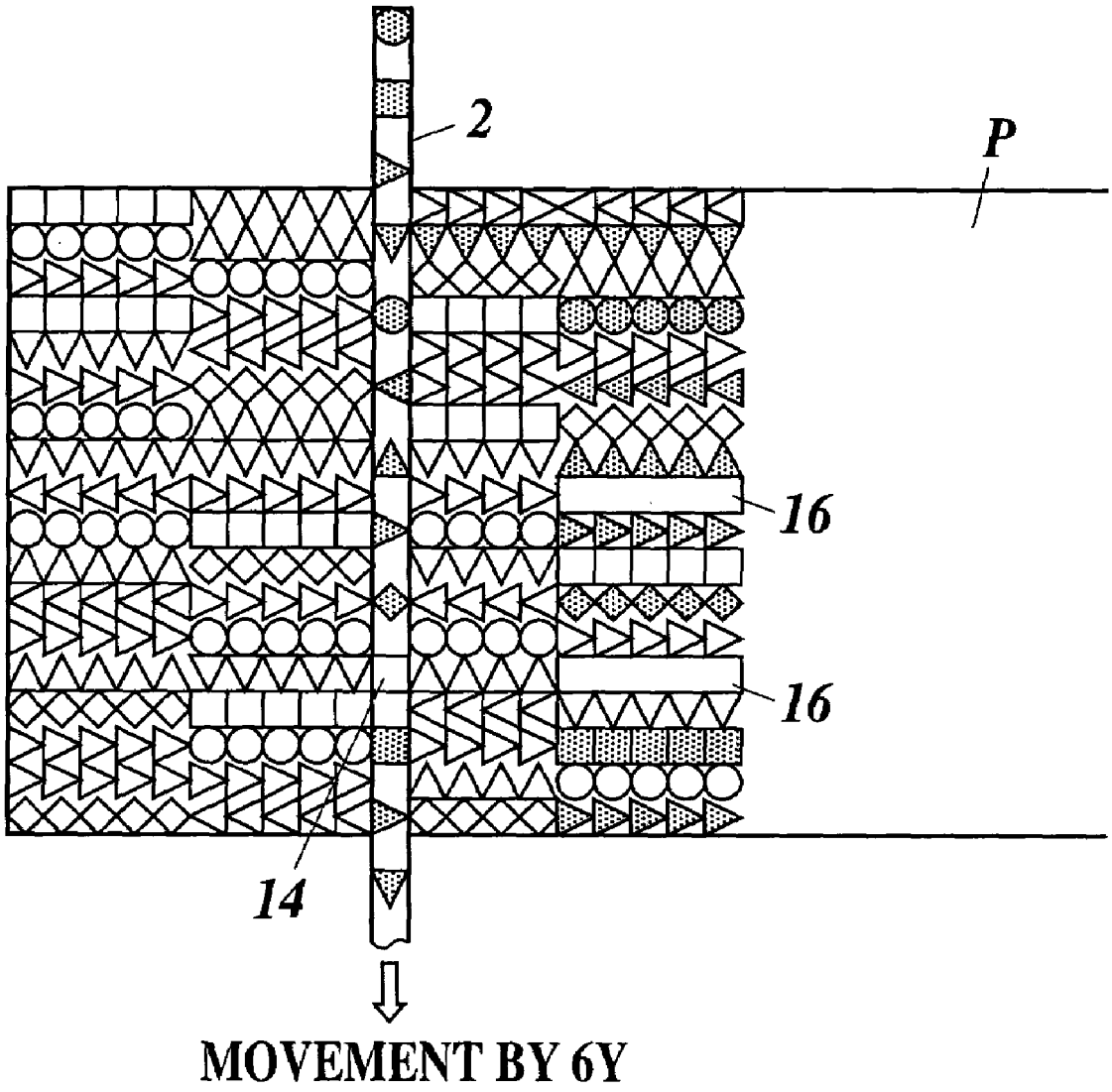
FIG. 34 is an illustration of the recording method in Embodiment 4.

Next, recording head 2 is moved, by distance 5Y, by the moving apparatus 5 to the lower side of the nozzle arrangement direction of the drawing. Then, the eighth scanning is started in which the recording medium P is moved, by "2A" mm, to the upstream of the conveyance direction, thereby recording an image as shown in FIG. 34. The eighth scanning also causes the recording medium P to be opposed to the no-jet nozzle 14, generating the no-ink-jet region 16. A nozzle opposed to the no-ink-jet region 16 that was generated in the fourth scanning jets ink, thus recording the no-ink-jet region 16.

Figure 35:
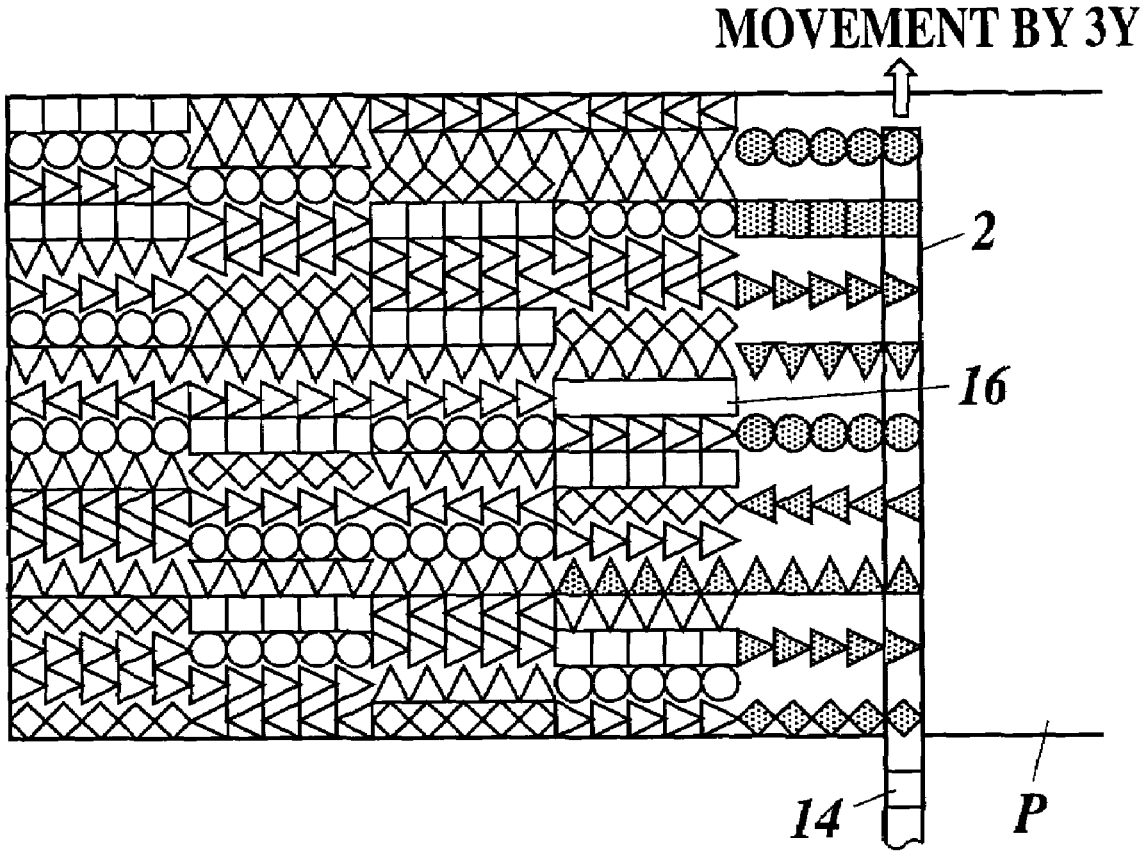
FIG. 35 is an illustration of the recording method in Embodiment 4.
Figure 36:
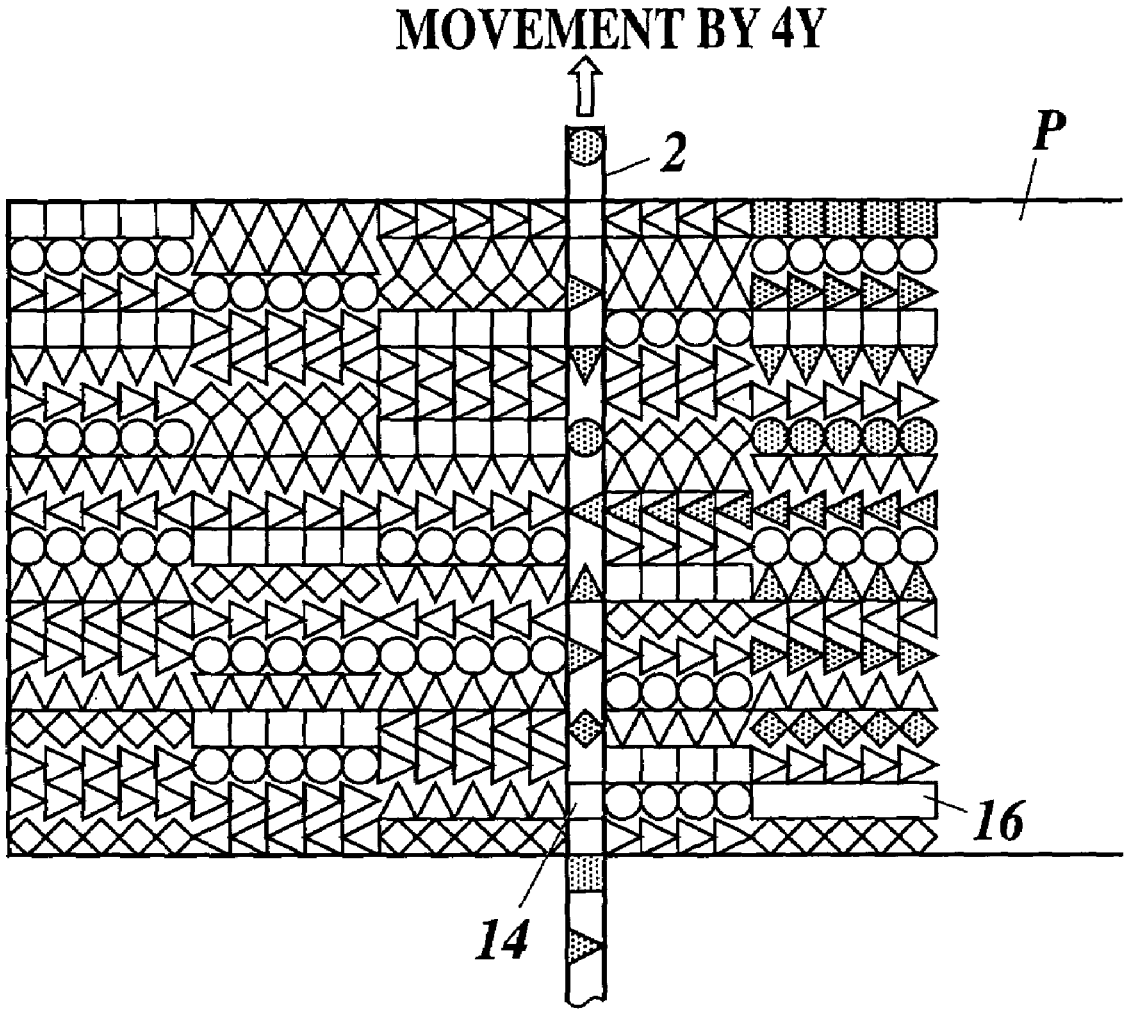
FIG. 36 is an illustration of the recording method in Embodiment 4.
Figure 37:
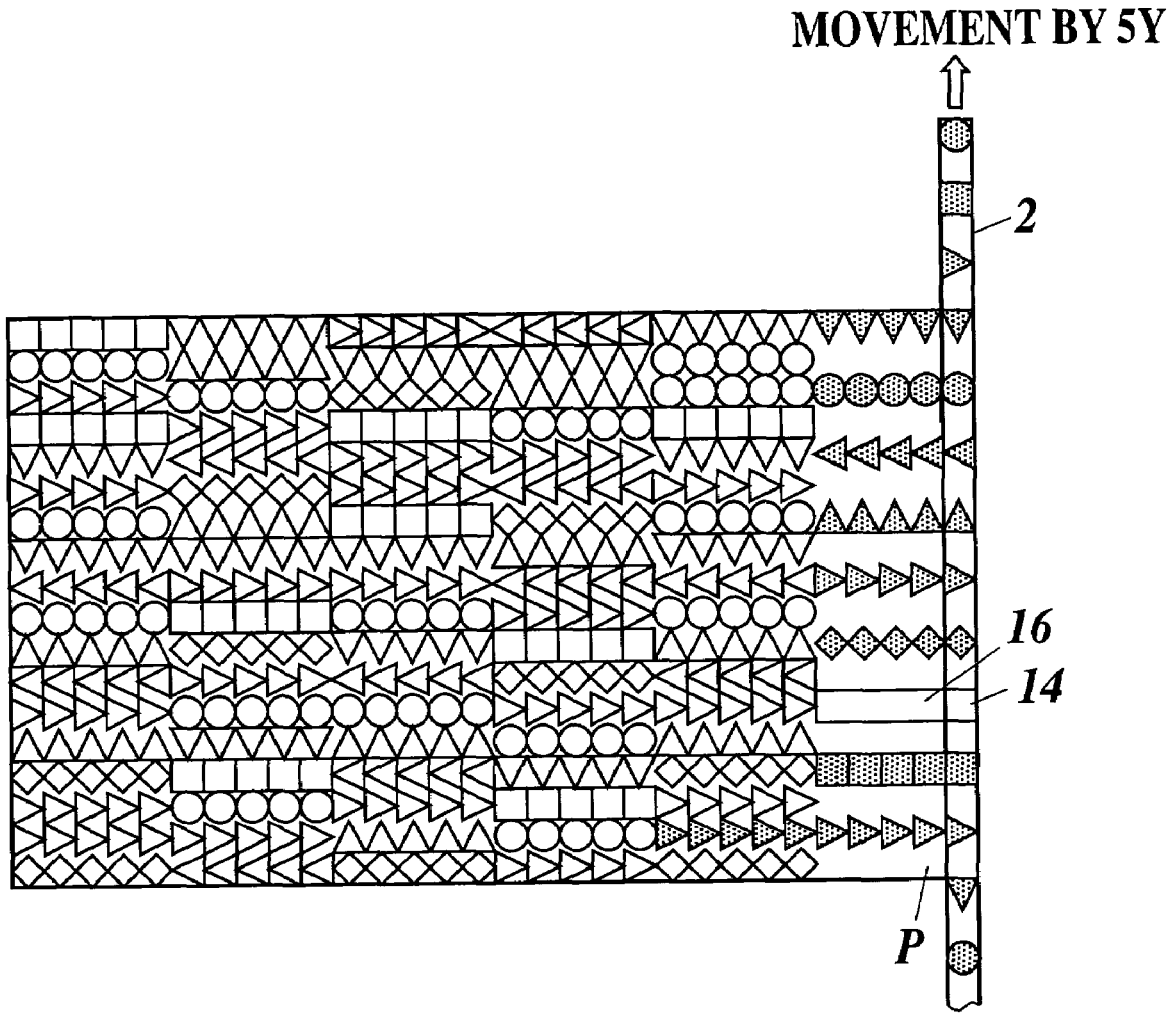
FIG. 37 is an illustration of the recording method in Embodiment 4.
Figure 38:
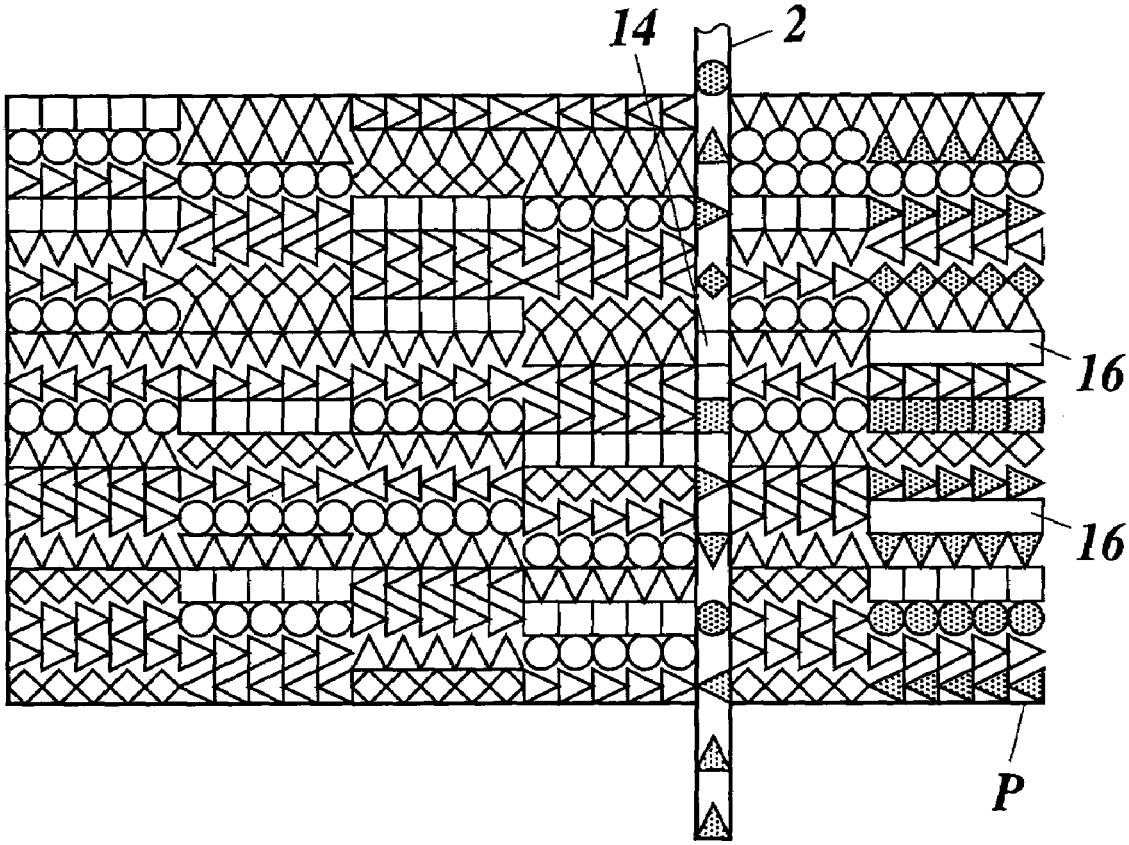
FIG. 38 is an illustration of the recording method in Embodiment 4.

Thereafter, the recording head 2 is moved, whenever each scanning is completed, in a predetermined direction and with a predetermined amount. In each scanning, the recording medium P repeats a cycle in which the recording medium P is conveyed, by "2A" mm, to the upstream of the conveyance direction and is conveyed, by "3A" mm, to the downstream of the conveyance direction. Moreover, a nozzle opposed to the no-ink-jet region 16 jets ink, thus providing the image recording. Thus, when the ninth scanning is completed, the recording head 2 and the recording medium P are recorded with the image shown in FIG. 35. When the tenth scanning is completed, the recording head 2 and the recording medium P are recorded with the image shown in FIG. 36. When the eleventh scanning is completed, the recording head 2 and the recording medium P are recorded with the image shown in FIG. 37. When the twelfth scanning is completed, the recording head 2 and the recording medium P are recorded with the image shown in FIG. 38.

As described above, the inkjet recording apparatus 1 of this embodiment not only provides the effect of Embodiment 1 but also moves, the recording head 2, in the nozzle arrangement direction, by a distance as a transfer unit obtained by multiplying the nozzle interval with m/n ("m" and "n" are natural numbers coprime to each other where $n \neq 1$) while changing the transfer unit from 3Y to 6Y in a stepwise manner whenever each scanning is completed. Thus, an image recording having a resolution equal to or higher than the nozzle interval can be provided. This embodiment also allows neighboring dots in the nozzle arrangement direction to be recorded by different nozzles. Thus, the stripe uneven recording along the conveyance direction can be dispersed to be unnoticeable. Furthermore, a nozzle opposed to the no-ink-jet region 16 that was generated by the no-jet nozzle 14 can provide an image recording, thus complementing the no-jet nozzle 14 easily.

Embodiment 5

Next, Embodiment 5 according to the present invention is described. The inkjet recording apparatus of Embodiment 5 has substantially the same structure as the inkjet recording apparatus 1 of Embodiment 1 except for a process for performing an image recording. The inkjet recording apparatus of Embodiment 5 is different from Embodiment 1 in that it is structured as in Embodiment 3 such that an image is recorded by three scannings to a part other than parts in the vicinity of the switching position and an image is recorded by five scannings to a part in the vicinity of the switching position. Specifically, each component is controlled so that a part of "B" mm in the vicinity of a position at which the conveyance direction of the recording medium P is switched is subjected to the dot thinning-out in the conveyance direction so that the part of "B" mm in the vicinity of the switching position is recorded with an image in an odd numbered scanning. This embodiment includes the no-jet nozzle 14 that is detected by the no-jet detection mechanism 15.

Hereinafter, each control configuration is described.

The control section 9 controls the moving apparatus 5 so that, whenever the conveyance direction of the recording medium P is switched, the recording head 2 is moved in the nozzle arrangement direction. When the nozzle interval is defined as "X", the amount of the movement of the recording head 2 is 3X, 4X, 5X, and 6X in this order and these amounts of the movement are repeated in this order. The recording head 2 is repeatedly moved with a cycle in which the recording head 2 is moved repeatedly by the respective distances 3X to 6X to the lower side of the nozzle arrangement direction in the drawing and is moved repeatedly by the respective distances 3X to 6X to the upper side of the nozzle arrangement direction.

The control section 9 controls the conveyance apparatus 4 so that the amount of the frontward movement of the recording medium P in the outward route is larger than the amount of the backward movement in the homeward route and so that the recording medium P is conveyed toward the downstream of the conveyance direction by an amount obtained by deducting, from the amount of the frontward movement in the outward route, the amount of the backward movement in the homeward route. When assuming that a part in the vicinity of a position at which the conveyance direction of the recording medium is switched is "B" mm, the recording medium P is caused to have a backward movement by (A+B) mm in an even numbered scanning except for the second scanning and the recording medium P is caused to have a frontward movement by "(2A+B)" mm in an odd numbered scanning except for the first scanning and the third scanning so that a control is provided by which the recording medium P is conveyed in the forward direction by "A" mm that is the difference between the above two distances. In this control, a place at which the conveyance direction of the recording medium P is switched is assumed to be of "B" mm corresponding to four dots in which a distance of "A" mm is larger than a distance of "B" mm.

In an odd numbered scanning, the head driving section 11 causes an image recording and, when the switching place of "B" mm is recorded, the head driving section 11 controls the recording head 2 so that the dot thinning-out is performed in the conveyance direction. Specifically, in each odd numbered scanning, a part of "B" mm from the record-starting position and a part of "B" mm from the record-completed position are subjected to the dot thinning-out in the conveyance direction so that one dot is skipped and the next one dot is recorded.

Next, the operation of the inkjet recording apparatus in this embodiment is described.

In this embodiment, one no-jet nozzle 14 is detected by the no-jet detection mechanism 15.

Figure 39:
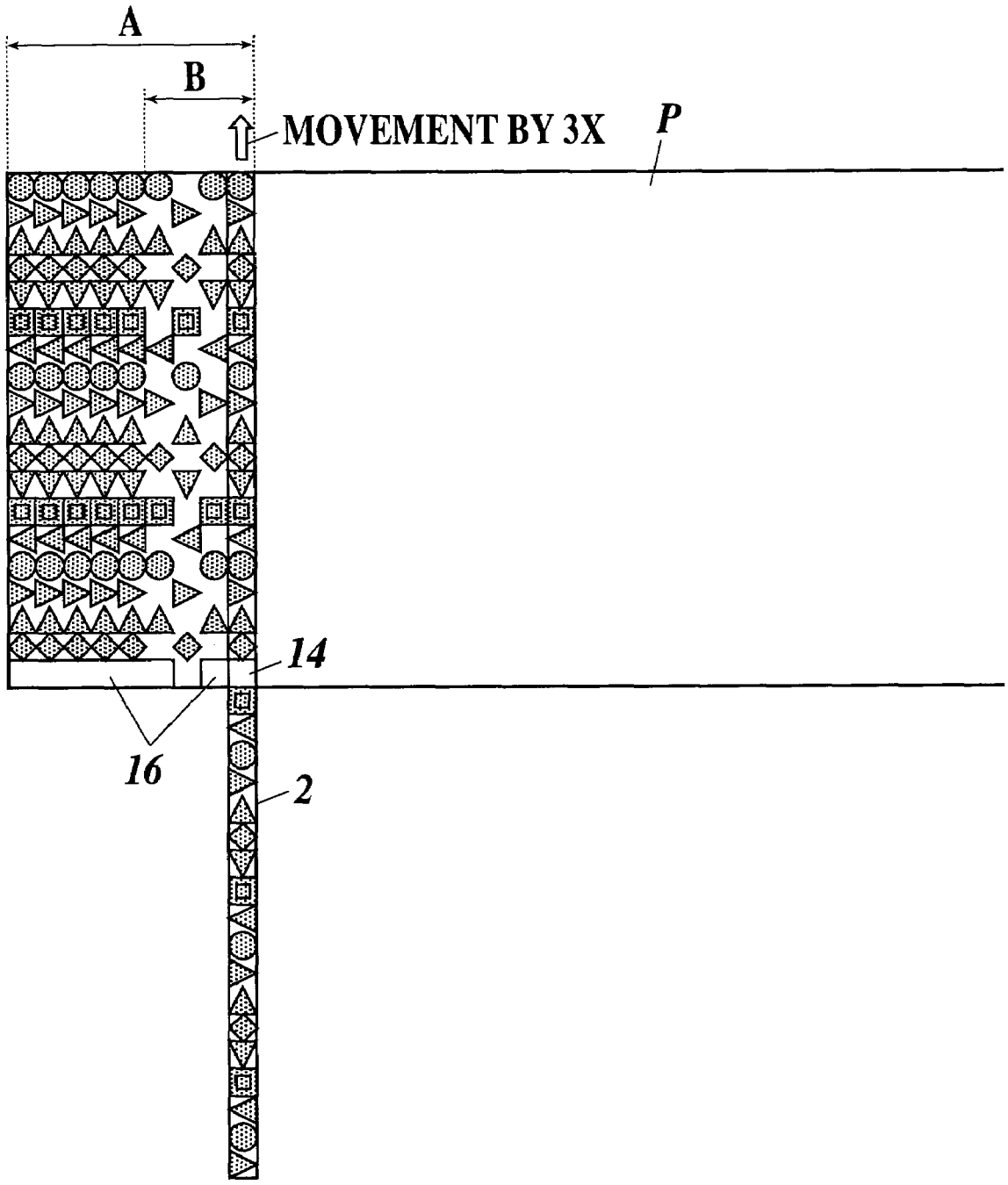
FIG. 39 is an illustration of a recording method in Embodiment 5.

First, the control section 9 is inputted with predetermined information regarding a to-be-recorded image. Then, the recording head 2 and the recording medium P are moved to a predetermined position. Thereafter, the first scanning is started in which the recording medium P is conveyed to the downstream of the conveyance direction by "A" mm. When recording a part of "B" mm from the switching position of the recording medium P in the conveyance direction to the upstream, the recording head 2 performs the dot thinning-out in the conveyance direction so that one dot is skipped and the next one dot is recorded. As a result, an image as shown in FIG. 39 is recorded. FIG. 39 shows the recording head 2 and the recording medium P after the first scanning. The dots provided with the hatching represent those recorded by the first scanning. Similarly, with regards to the dots in the drawings, only the dots recorded in each scanning operation is provided with a hatching in the following description.

Figure 40:
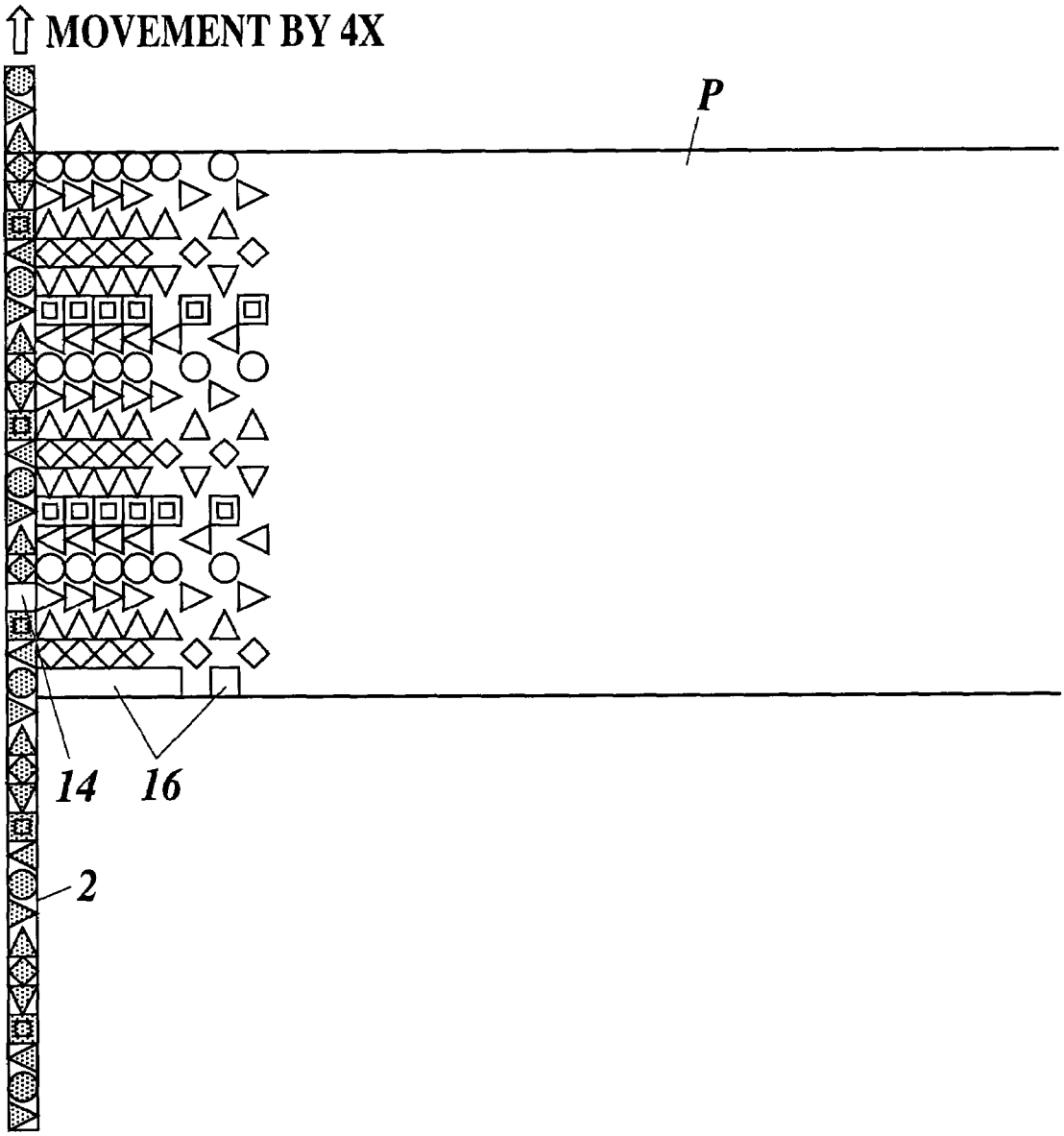
FIG. 40 is an illustration of the recording method in Embodiment 5.

Next, the recording head 2 is moved by the moving apparatus 5 by the distance 3X to the upside of the nozzle arrangement direction of the drawing. Then, the second scanning is started in which an image recording is not performed and the recording medium P is conveyed by "A" mm to the upstream of the conveyance direction, thus providing a status as shown in FIG. 40.

Figure 41:
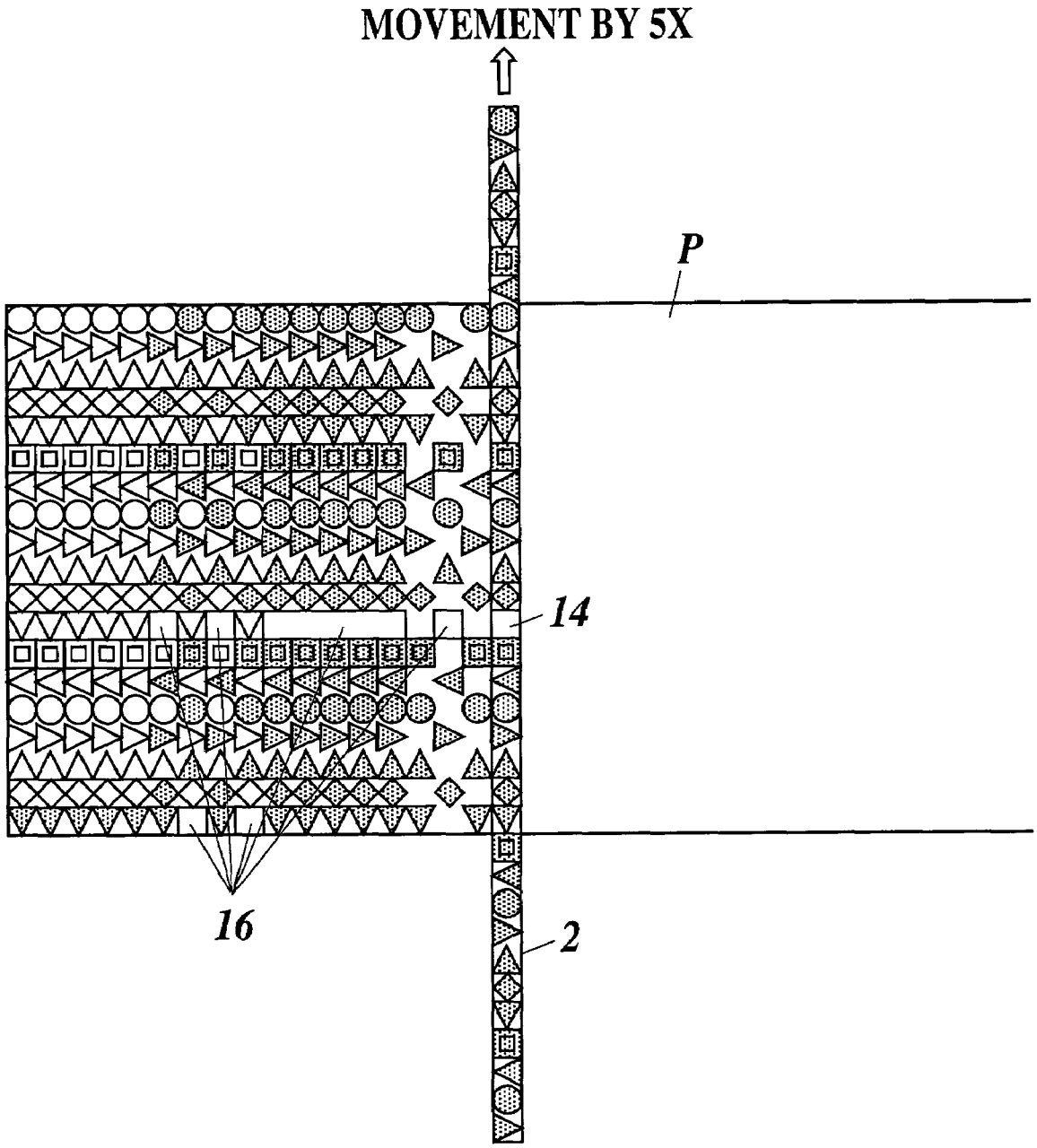
FIG. 41 is an illustration of the recording method in Embodiment 5.

Next, the recording head 2 is again moved, by the distance 4X, by the moving apparatus 5 to the upside of the nozzle arrangement direction of the drawing. Then, the third scanning is started in which the recording medium P is conveyed, by "2A" mm, to the downstream of the conveyance direction, thereby recording an image as shown in FIG. 41. Then, when recording a part of "B" mm from the record-completed position of the third scanning to the upstream of the conveyance direction, the part is subjected to the dot thinning-out in the conveyance direction so that one dot is skipped and the next one dot is recorded. A region of "A" mm from the record-starting position is already recorded with the image in the first scanning; and in the third scanning, the no-ink-jet region 16 opposed to the no-jet nozzle 14 that was generated in the first scanning is subjected to an image recording. As described above, the image recording of a part of "(A−B)" mm from the record-starting position is completed.

Figure 42:
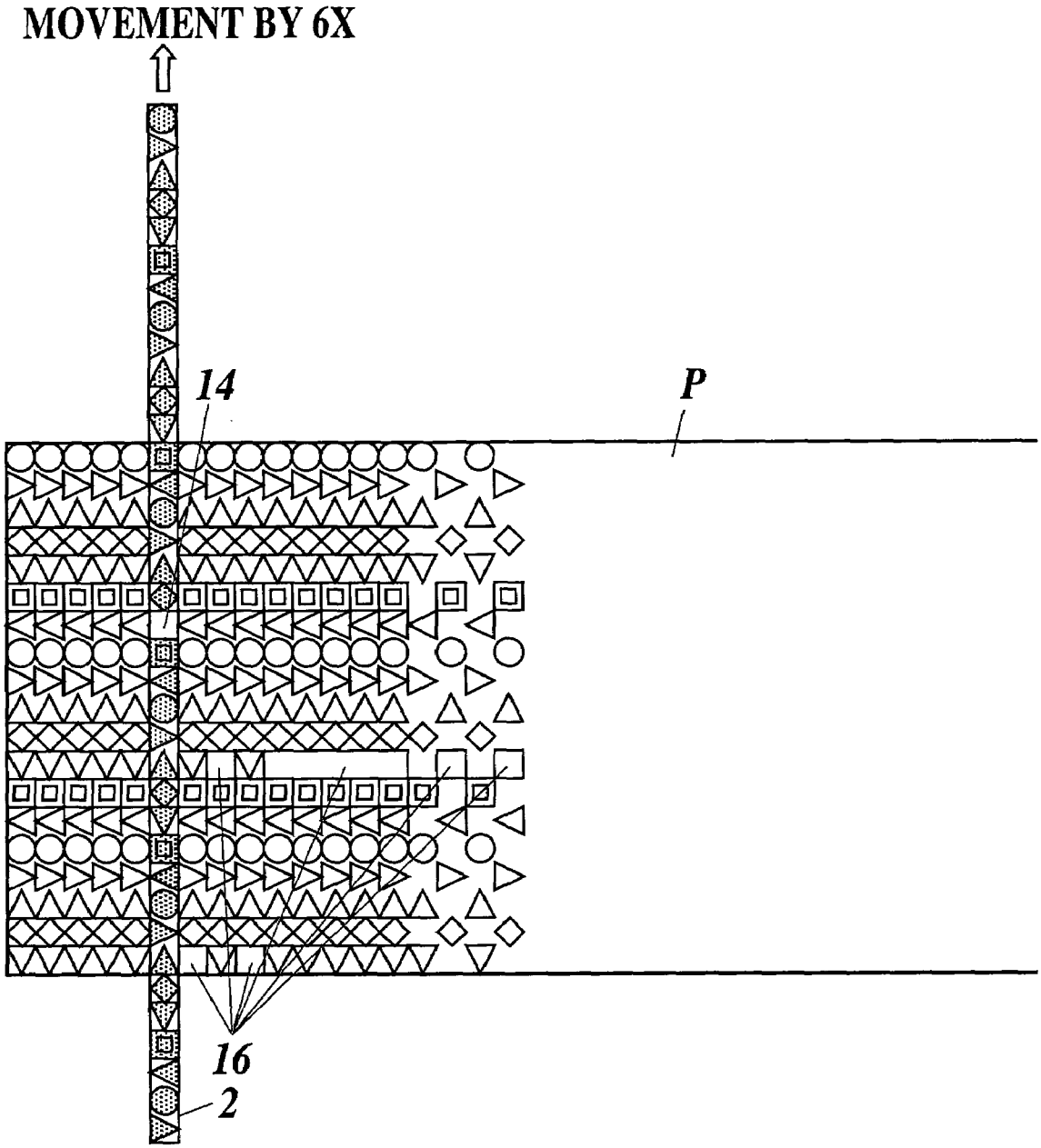
FIG. 42 is an illustration of the recording method in Embodiment 5.

Next, the recording head 2 is moved, by the distance 5X, by the moving apparatus 5 to the upside of the nozzle arrangement direction of the drawing. Then, the fourth scanning is started in which an image recording is not performed and the recording medium P is moved, by "(A+B)" mm, to the upstream of the conveyance direction, thereby providing a status as shown in FIG. 42.

Figure 43:
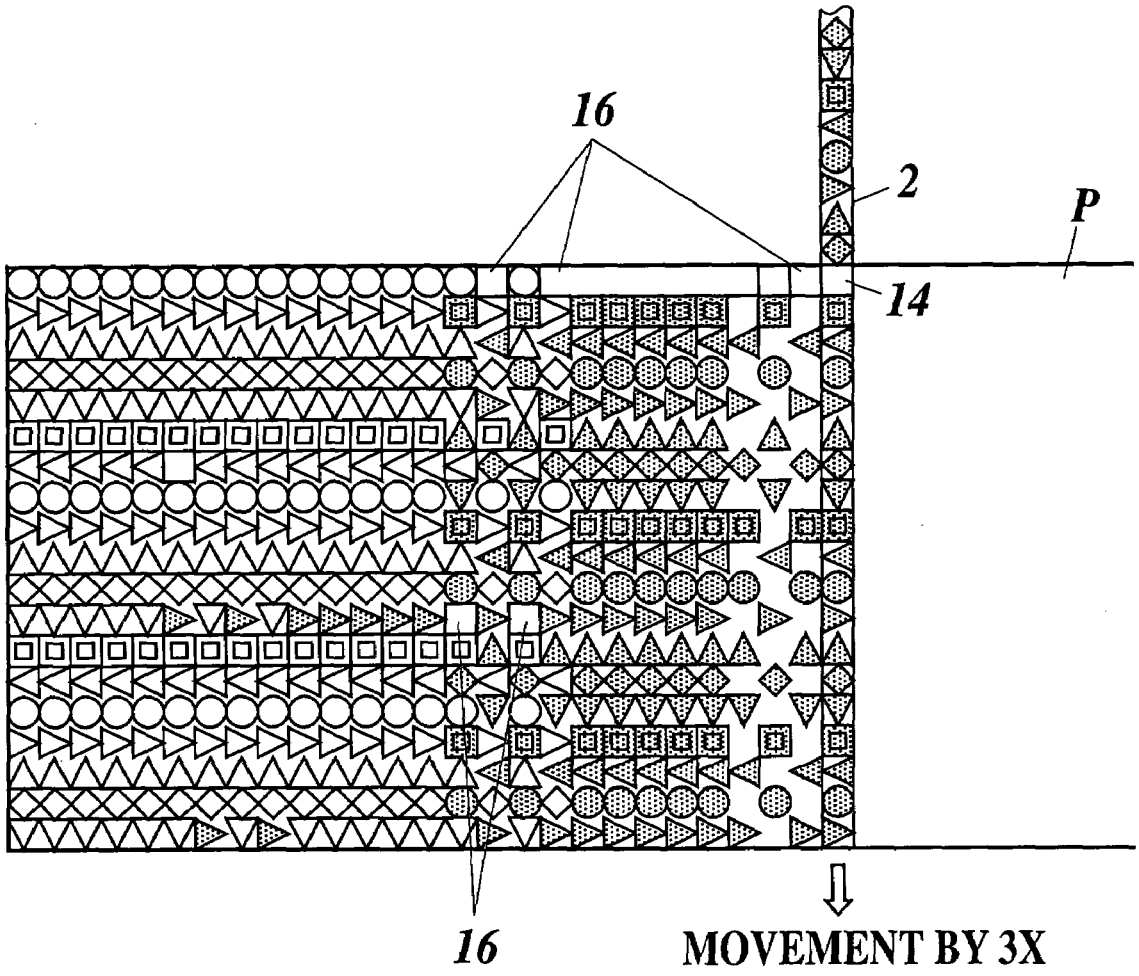
FIG. 43 is an illustration of the recording method in Embodiment 5.

Then, the recording head 2 is moved, by the distance 6X, to the upside of the nozzle arrangement direction of the drawing. Then, the fifth scanning is started in which the recording medium P is conveyed, by "(2A+B)" mm, to the downstream of the conveyance direction, thereby recording an image as shown in FIG. 43. Then, a region of "B" mm from the record-starting position and a region of "B" mm from the record-completed position of the fifth scanning is subjected to the dot thinning-out in the conveyance direction so that one dot is skipped and the next one dot is recorded. At the same time, the no-ink-jet region 16 generated in the third scanning is subjected to an image recording. Thus, an image recording to a part of "A" mm from the position at which the third scanning is completed is finished.

Figure 44:
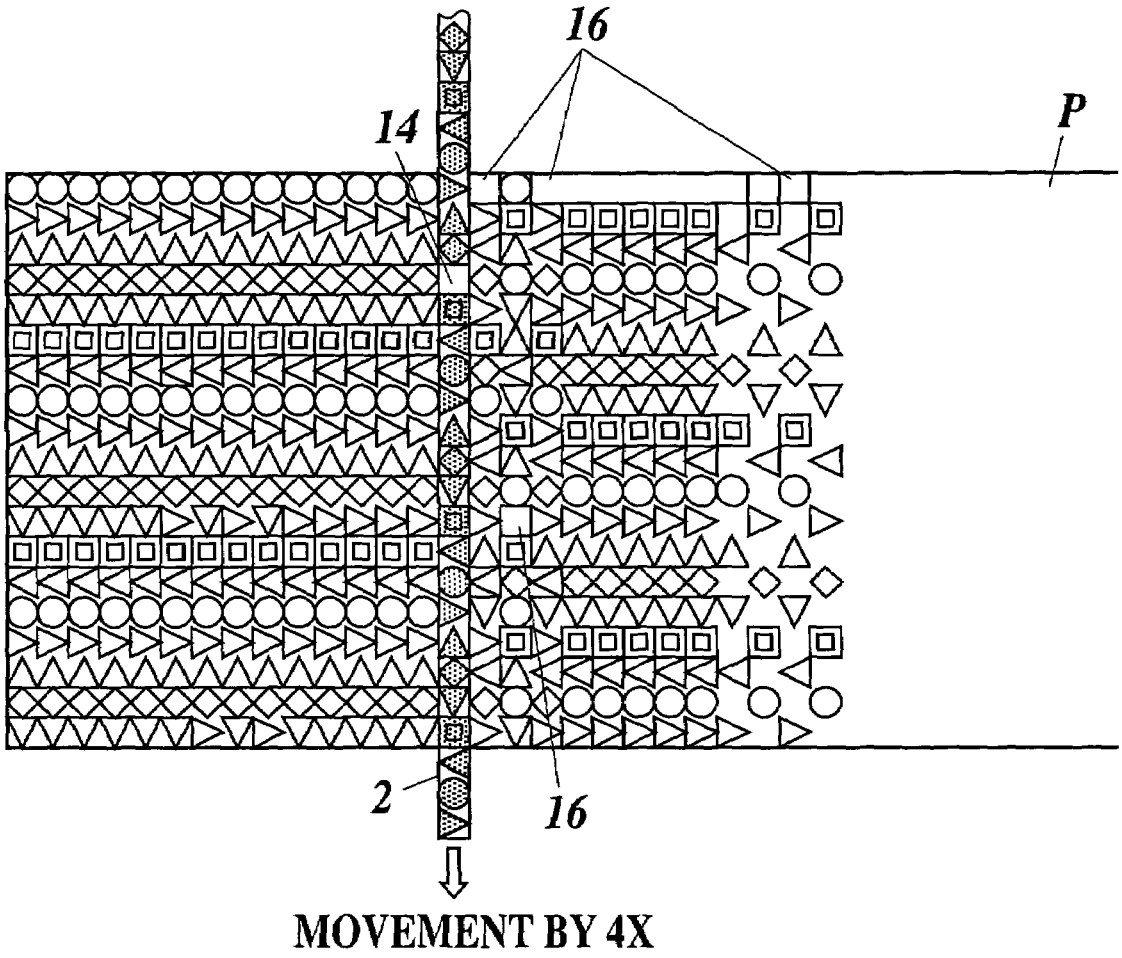
FIG. 44 is an illustration of the recording method in Embodiment 5.
Figure 45:
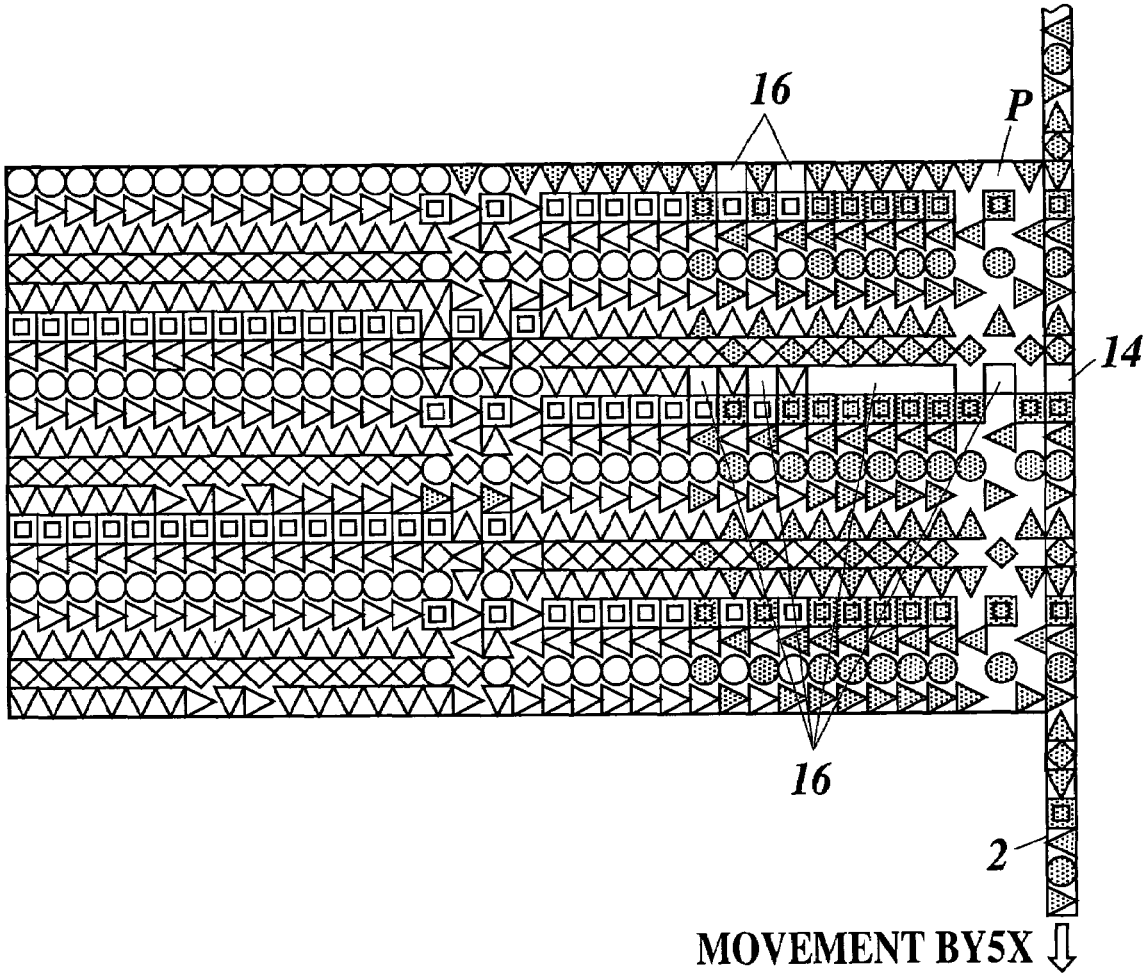
FIG. 45 is an illustration of the recording method in Embodiment 5.
Figure 46:
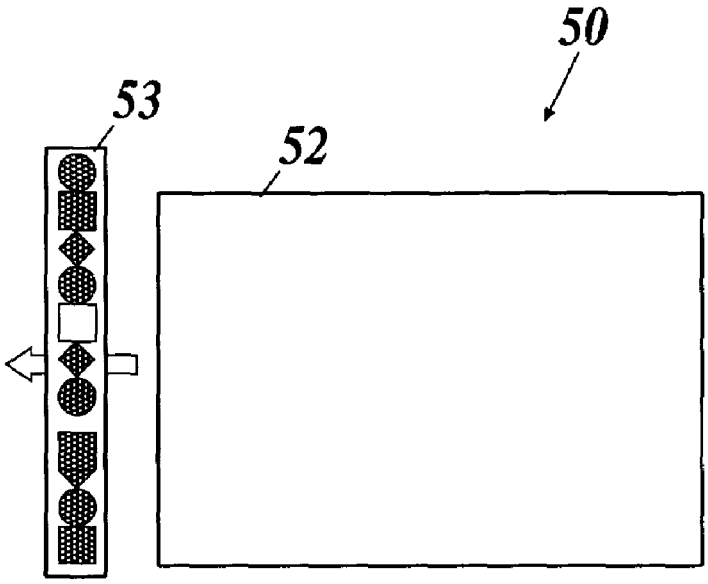
FIG. 46 is an illustration of a conventional recording method.
Figure 47:
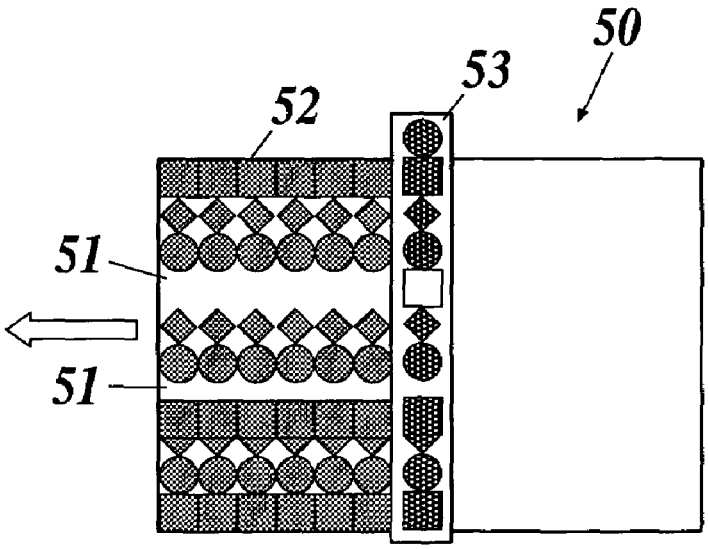
FIG. 47 is an illustration of the conventional recording method.
Figure 48:
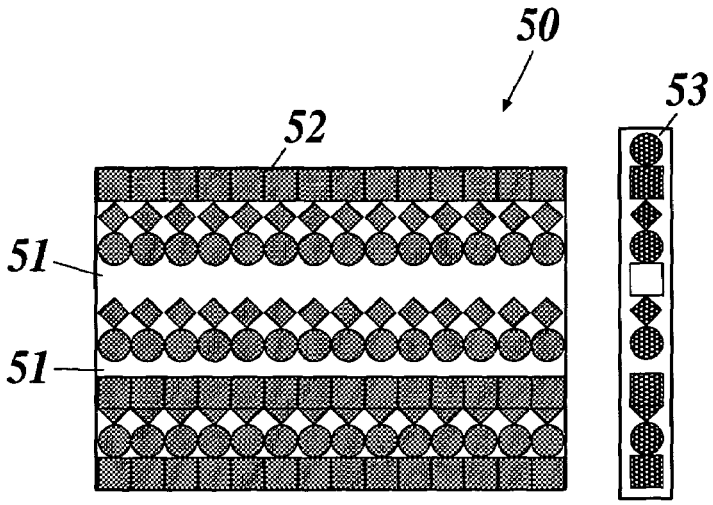
FIG. 48 is an illustration of the conventional recording method.
Figure 49:
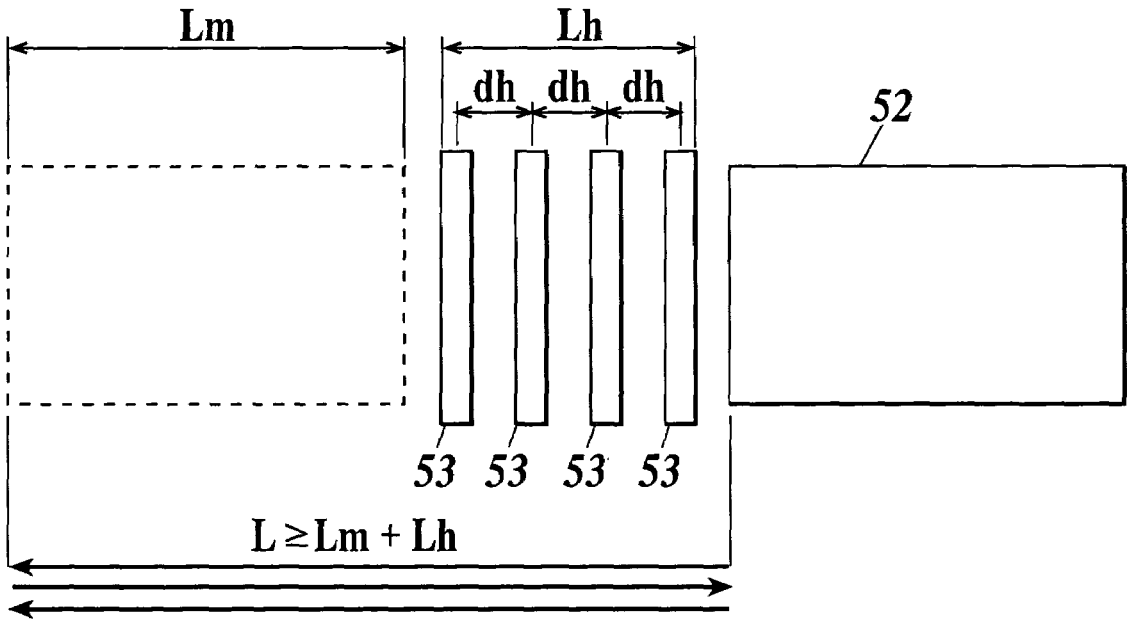
FIG. 49 is an illustration of the conventional recording method.

Thereafter, whenever each scanning is completed, the recording head 2 is moved by a predetermined amount in a predetermined direction. In each scanning, the recording medium P is repeatedly conveyed with a cycle in which the recording medium P is conveyed by "A" mm to the upstream of the conveyance direction and is conveyed by "2A" mm to the downstream of the conveyance direction. Moreover, in each odd numbered scanning, the recording head 2 performs the dot thinning-out to a part of "B" mm from the record-starting position and a part of "B" mm from the record-completed position while recording an image to the no-ink-jet region 16. Thus, the recording head 2 and the recording medium P when the sixth scanning is completed are in a status as shown in FIG. 44. When the seventh scanning is completed, an image as shown in FIG. 45 is recorded.

By providing the image recording in the manner as described above, an effect as by Embodiment 2 can be provided by which stripe uneven recording of a part in the vicinity of a position at which the conveyance direction is switched can be dispersed and the no-jet nozzle 14 can be complemented.

As described above, the inkjet recording apparatus 1 of this embodiment not only provides the effect of Embodiment 1 but also can avoid the stripe uneven recording in the nozzle arrangement direction caused by an error in the conveyance of the recording medium while providing an image recording securely because neighboring dots in the nozzle arrangement direction are recorded, at a part of "B" mm from the position at which the conveyance direction of the recording medium P is switched, by different nozzles. The inkjet recording apparatus 1 of this embodiment also records an image to a part of "B" mm from the position at which the conveyance direction of the recording medium P is switched while subjecting the part to the dot thinning-out. Thus, the stripe uneven recording in the nozzle arrangement direction caused by the error in the conveyance of the recording medium can be avoided securely. Furthermore, the recording head 2 is moved in the nozzle arrangement direction by a distance as a transfer unit that is obtained by multiplying the nozzle interval with m/n ("m" and "n" are natural numbers coprime to each other where $n \neq 1$), and whenever each scanning is completed, the distance is changed within a range from 3Y to 6Y in a stepwise manner. Thus, an image recording with a resolution equal to or higher than the nozzle interval can be performed. Additionally, the neighboring dots in the nozzle arrangement direction recorded by different nozzles also can disperse the stripe uneven recording along the conveyance direction to an unnoticeable level.

In this embodiment, the recording head 2 was moved in the nozzle arrangement direction by a distance obtained by multiplying the nozzle interval X with an integer and all image recordings were performed in an odd numbered scanning. However, the amount of the movement of the recording head 2 can be appropriately changed and only an image recording to the no-ink-jet region 16 also may be performed in an even numbered scanning.

The entire disclosure of Japanese Patent Application No. 2004-254318 which was filed on Sep. 1, 2004, and of Japanese Patent Application No. 2005-010507 which was filed on Jan. 18, 2005,including specification, claims, drawings and abstract, is incorporated into the present invention in its entirety.

What is claimed is:

1. An inkjet recording apparatus comprising:

a line head type recording head which includes a plurality of nozzles for jetting ink to a recording medium;

a moving apparatus for moving the recording head relative to the recording medium in a nozzle arrangement direction;

a conveyance apparatus for conveying, in a reciprocating manner, the recording medium relative to the recording head in a direction orthogonal to the nozzle arrangement direction;

a head driving section for controlling the recording head so that the recording head jets ink based on inputted image information; and a control section for controlling the conveyance apparatus so that an amount of forward movement of the recording medium is larger than an amount of backward movement of the recording medium, and for controlling the moving apparatus, when a conveyance direction is switched, so that the recording head is moved relative to the recording medium in the nozzle arrangement direction;

wherein a plurality of recording heads are provided in the conveyance direction with a predetermined interval therebetween; and wherein the control section controls the conveyance apparatus so that the amount of the forward movement of the recording medium is less than the interval between the recording heads.

2. An inkjet recording apparatus comprising:

a line head type recording head which includes a plurality of nozzles for jetting ink to a recording medium;

a moving apparatus for moving the recording head relative to the recording medium in a nozzle arrangement direction;

a conveyance apparatus for conveying, in a reciprocating manner, the recording medium relative to the recording head in a direction orthogonal to the nozzle arrangement direction;

a head driving section for controlling the recording head so that the recording head jets ink based on inputted image information; and a control section for controlling the conveyance apparatus so that an amount of forward movement of the recording medium is larger than an amount of backward movement of the recording medium and so that the amount of the forward movement and the amount of the backward movement are less than a length of the recording medium, and for controlling the moving apparatus, when the conveyance direction is switched, so that the recording head is moved relative to the recording medium in the nozzle arrangement direction;

wherein a plurality of recording heads are provided in the conveyance direction with a predetermined interval therebetween; and wherein the control section controls conveyance apparatus so that the amount of the forward movement is shorter than the interval of the recording heads.

3. The inkjet recording apparatus of claim 2, wherein the head driving section controls the recording heads so that a dot thinning-out is provided, during image recording, in the conveyance direction of the recording medium so that a part in a vicinity of a position at which the conveyance direction of the recording medium is switched is subjected to the image recording by a plurality of scannings.

* * * * *